US009335101B2

(12) United States Patent
Achammer et al.

(10) Patent No.: US 9,335,101 B2
(45) Date of Patent: May 10, 2016

(54) LED LAMP

(75) Inventors: Daniel G. Achammer, Warrenville, IL (US); Daniel B. McGowan, Glen Ellyn, IL (US); Victor Zaderej, Wheaton, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/110,654

(22) PCT Filed: Apr. 11, 2012

(86) PCT No.: PCT/US2012/032980

§ 371 (c)(1), (2), (4) Date: Nov. 13, 2013

(87) PCT Pub. No.: WO2012/142068

PCT Pub. Date: Oct. 18, 2012

(65) Prior Publication Data

US 2014/0055997 A1 Feb. 27, 2014

Related U.S. Application Data

(60) Provisional application No. 61/474,077, filed on Apr. 11, 2011.

(51) Int. Cl.

| | |
|---|---|
| ***F21V 29/74*** | (2015.01) |
| ***F28F 3/02*** | (2006.01) |
| ***F21K 99/00*** | (2016.01) |
| ***F21V 29/71*** | (2015.01) |
| ***F21V 29/77*** | (2015.01) |
| ***F21V 29/83*** | (2015.01) |

(Continued)

(52) U.S. Cl.

CPC ... *F28F 3/02* (2013.01); *F21K 9/00* (2013.01); *F21K 9/137* (2013.01); *F21K 9/50* (2013.01); *F21V 29/713* (2015.01); *F21V 29/74* (2015.01); *F21V 29/773* (2015.01); *F21V 29/83* (2015.01); *F21V 29/70* (2015.01); *F21Y 2101/02* (2013.01)

(58) Field of Classification Search

CPC . F21V 29/22; F21V 29/2206; F21V 29/2262; F21V 29/2293; F21V 29/26; F21V 29/262; F21V 29/2225

See application file for complete search history.

(56) References Cited

U.S. PATENT DOCUMENTS

| | | | | |
|---|---|---|---|---|
| 7,661,854 | B1 | 2/2010 | Yang et al. | |
| 7,679,096 | B1 * | 3/2010 | Ruffin | 257/99 |

(Continued)

FOREIGN PATENT DOCUMENTS

| | | | |
|---|---|---|---|
| CN | 201237110 | Y | 5/2009 |
| CN | 101846260 | A | 9/2010 |

(Continued)

OTHER PUBLICATIONS

International Search Report for PCT/US2012/032980.

*Primary Examiner* — Julie Bannan
(74) *Attorney, Agent, or Firm* — Jeffrey K. Jacobs

(57) ABSTRACT

An LED array is thermally coupled to a heat spreader and a heat sink. The heat sink has a base and a plurality of fins extending from the base. Each fin includes a lower portion which extends outwardly from the base and downwardly from the heat spreader, and an upper portion that extends upwardly from the base and is offset from the lower portion so as to form a junction. An aperture may be provided through each junction to allow air to pass therethrough. The heat spreader may also have fins.

9 Claims, 24 Drawing Sheets

(51) Int. Cl.
*F21Y 101/02* (2006.01)
*F21V 29/70* (2015.01)

(56) References Cited

U.S. PATENT DOCUMENTS

| | | | | |
|---|---|---|---|---|
| 2004/0066142 | A1 | 4/2004 | Stimac et al. | |
| 2008/0266866 | A1* | 10/2008 | Tsai | 362/294 |
| 2009/0046473 | A1* | 2/2009 | Tsai et al. | 362/373 |
| 2009/0296387 | A1* | 12/2009 | Reisenauer et al. | 362/235 |
| 2009/0296402 | A1 | 12/2009 | Chang et al. | |
| 2010/0124058 | A1* | 5/2010 | Miller | 362/249.02 |
| 2010/0242519 | A1* | 9/2010 | Breidenassel et al. | 62/264 |
| 2010/0259935 | A1* | 10/2010 | Scordino et al. | 362/294 |
| 2010/0327751 | A1* | 12/2010 | Takenaka et al. | 315/113 |
| 2011/0025211 | A1* | 2/2011 | Bae | 315/113 |
| 2011/0204779 | A1* | 8/2011 | Shum et al. | 315/35 |

FOREIGN PATENT DOCUMENTS

| | | | |
|---|---|---|---|
| CN | 201322284 | Y | 7/2014 |
| JP | 2010-073569 | A | 4/2010 |
| JP | 2010-114060 | A | 5/2010 |
| JP | 3164817 | U | 11/2010 |
| KR | 10-0927114 | B1 | 11/2009 |
| KR | 2010-0124411 | A | 11/2010 |
| TW | M401101 | | 4/2011 |

* cited by examiner

LED LAMP

RELATED APPLICATIONS

This applications is a national phase of PCT Application No. PCT/US2012/032980, filed Apr. 11, 2012, which in turn claims priority to U.S. Provisional Application No. 61/474,077, filed Apr. 11, 2011, which is incorporated herein by reference in its entirety.

FIELD OF THE INVENTION

The present invention relates to field of illumination, more specifically to a lamp for use with a light emitting diode.

BACKGROUND OF THE INVENTION

Typically, a light fixture designer has used a conventional, known light source and focused efforts on shaping the emitted light so as to provide the desired compromise between the total light output (efficiency) and the desired footprint of the emitted light. Issues like thermal management were peripheral. With a light emitting diode (LED), however, issues like changes in the light output over time, the potential need to convert to DC power, and the need for careful thermal management become much more significant. To further complicate this, LED technology continues to evolve at a rapid pace, making it difficult to design a fixture that directly integrates the LEDs into the fixture.

One known issue with LEDs is that it is important to keep the temperature of the LED cool enough so that the potential life of the LED can be maintained. Otherwise, the heat will cause the light output of the LED to quickly degrade and the LED will cease to provide the rated light output long before the LED would otherwise cease to function properly. Therefore, while the heat output of LEDs is not extreme, the relative sensitivity of the LED to the heat causes heat management to become a relatively important issue. Existing designs may not fully account for the heat generated, tend to provide relatively limited lumen output or tend to use expensive thermal management solutions that make the design of the LED replacement bulb extremely costly. Therefore, individuals would appreciate further improvements in LED light modules that could provide a cost effective solution to the issue of heat management.

SUMMARY OF THE INVENTION

A lamp includes a light emitting diode (LED) that is mounted on a base and is thermally coupled to a heat spreader, which in turn is thermally coupled to a heat sink. The heat sink has a base and a plurality of fins extending from the base. The heat spreader is supported by the base and helps transfers heat from the LED to the heat sink. In an embodiment, each fin includes a lower portion which extends outwardly from the base, and an upper portion that extends upwardly from the base and is offset from the lower portion. An aperture may be provided through each upper portion to allow air to pass therethrough. In another embodiment, the heat spreader includes fins and the heat sink. The heat spreader can extend further forward than the heat sink so assist in providing thermal management. In each embodiment, the height of the lamp can be less than 90 mm while allowing for an output of greater than 500 lumens.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
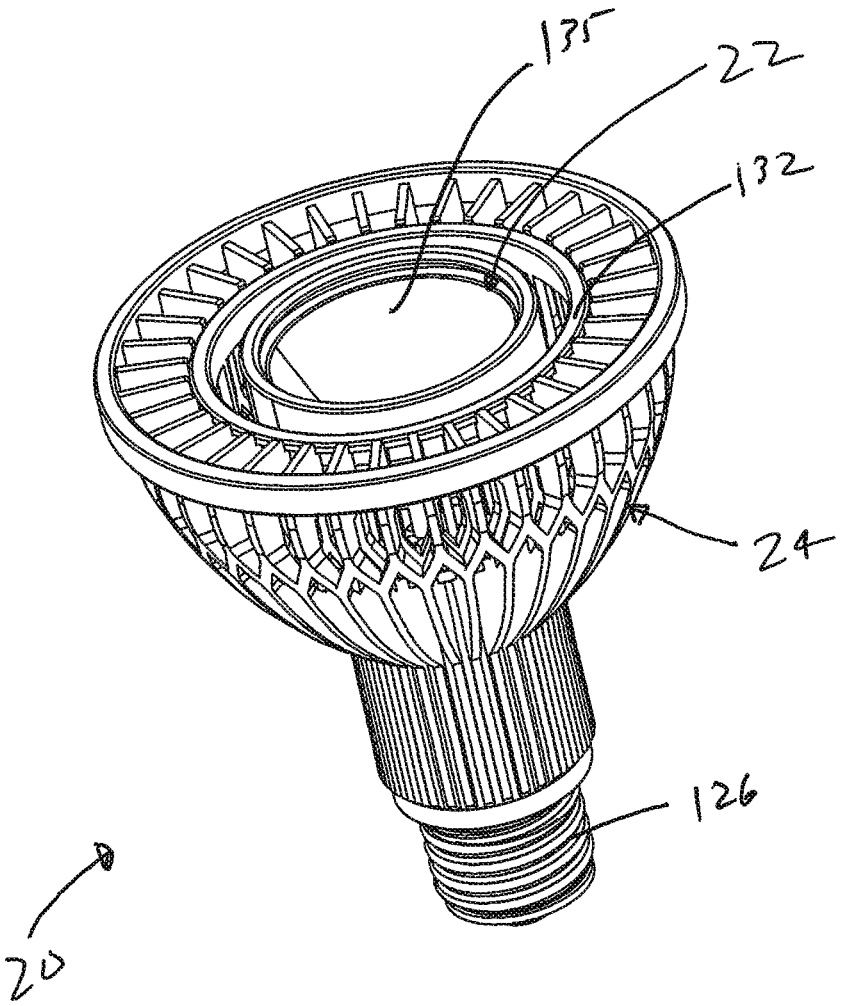
FIG. 1 is a top perspective view of an embodiment of a lamp.

While the invention may be susceptible to embodiment in different forms, there is shown in the drawings, and herein will be described in detail, specific embodiments with the understanding that the present disclosure is to be considered exemplary, and is not intended to limit the invention to that as illustrated and described herein. Therefore, unless otherwise noted, features disclosed herein may be combined together to form additional combinations that were not otherwise shown for purposes of brevity. While the terms lower, upper and the like are used for ease in describing the disclosed embodiments, it is to be understood that these terms do not denote a required orientation for use of the disclosed modules.

A lamp 20, 220 (which as illustrated is a parabolic reflector type lamp) includes a LED assembly 22, 222 and a heat sink assembly 24, 224 for dissipating heat generated by the LED assembly 22, 222. The heat sink assembly 24, 224 includes a heat sink 26, 226 and a heat spreader 28, 228. A thermal pad 30 may be positioned between the heat sink 26, 226 and the heat spreader 28, 228. An embodiment of the heat sink assembly 24 is shown in FIGS. 1-12, Another embodiment of the heat sink assembly 224 is shown in FIGS. 14-22.

Attention is invited to the embodiment of the heat sink assembly 24 shown in FIGS. 1-12. As best illustrated in FIGS. 3-7, the heat sink 26 includes a cylindrical base 32 having a central passageway 34 therethrough which defines a centerline 36. A plurality of spaced-apart, elongated fins 38 extend from the base 32. Each fin 38 has a lower portion 39 which extends outwardly from the base 32 and an upper portion 62 which extends upwardly from the base 32.

Figure 4:
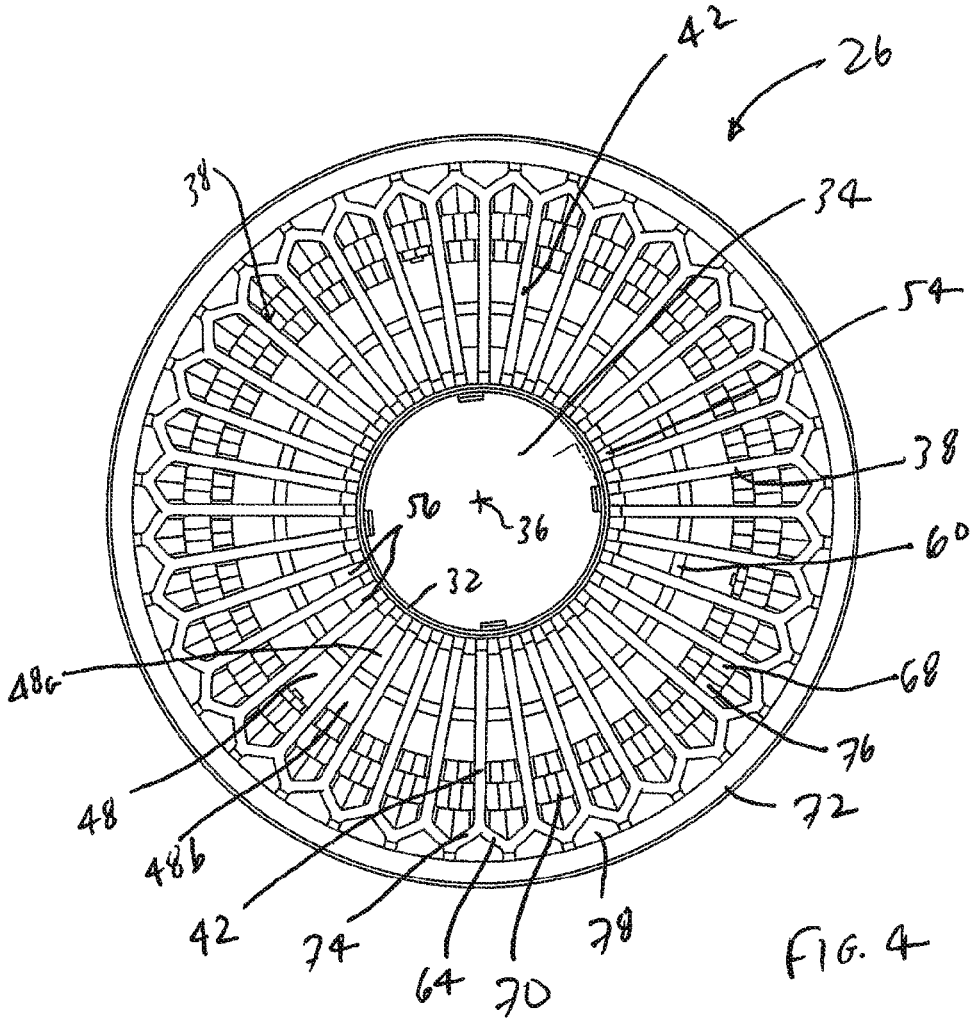
FIG. 4 is a bottom plan view of the heat sink of FIG. 3.
Figure 6:
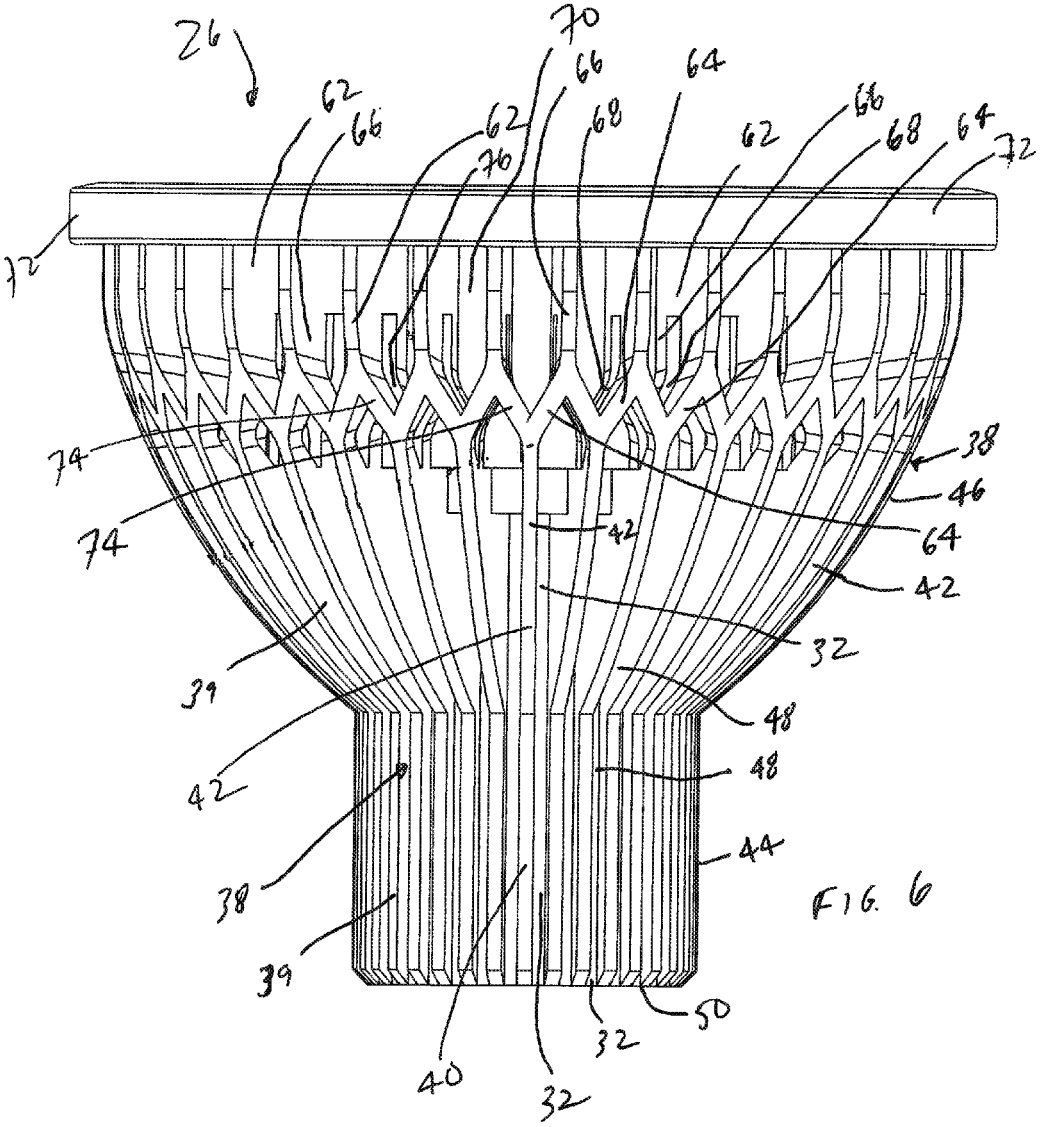
FIG. 6 is a side elevational perspective view of the heat sink of FIG. 3.
Figure 7:
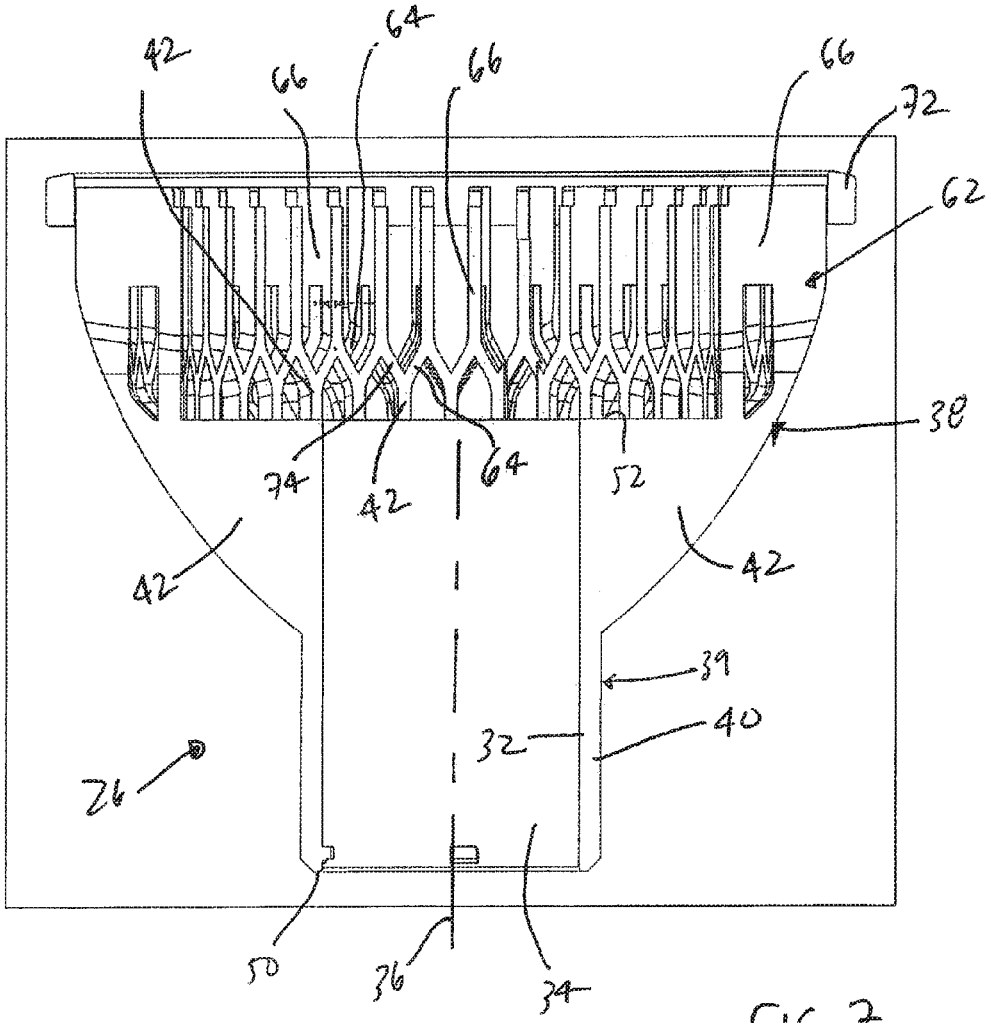
FIG. 7 is a cross-sectional view of the heat sink along line 7-7 of FIG. 5.

As best shown in FIG. 7, the lower portion 39 of each fin 38 has a lower section 40 which is straight and extends radially outwardly from the base 32, and an upper section 42 which extends radially outwardly from the base 32. An outer edge 44, FIG. 6, of each lower section 40 falls along a concentric circle. While these lower sections 40 are shown as straight and radial, other shapes can be used as desired (for example, the lower sections 40 may be wavy and/or extend at an angle relative to the base 32). The upper section 42 of each fin 38 is vertically aligned with the respective lower section 40. Each upper section 42 extends upwardly from the lower section 40 and has an outer edge 46 which curves outwardly relative to the respective lower section 40. As a result, vertical channels 48, FIG. 4, are formed between adjacent lower sections 40/upper sections 42 which allow air to circulate from a bottom end 50 of the base 32 to a top end 52 of the base 32.

Figure 5:
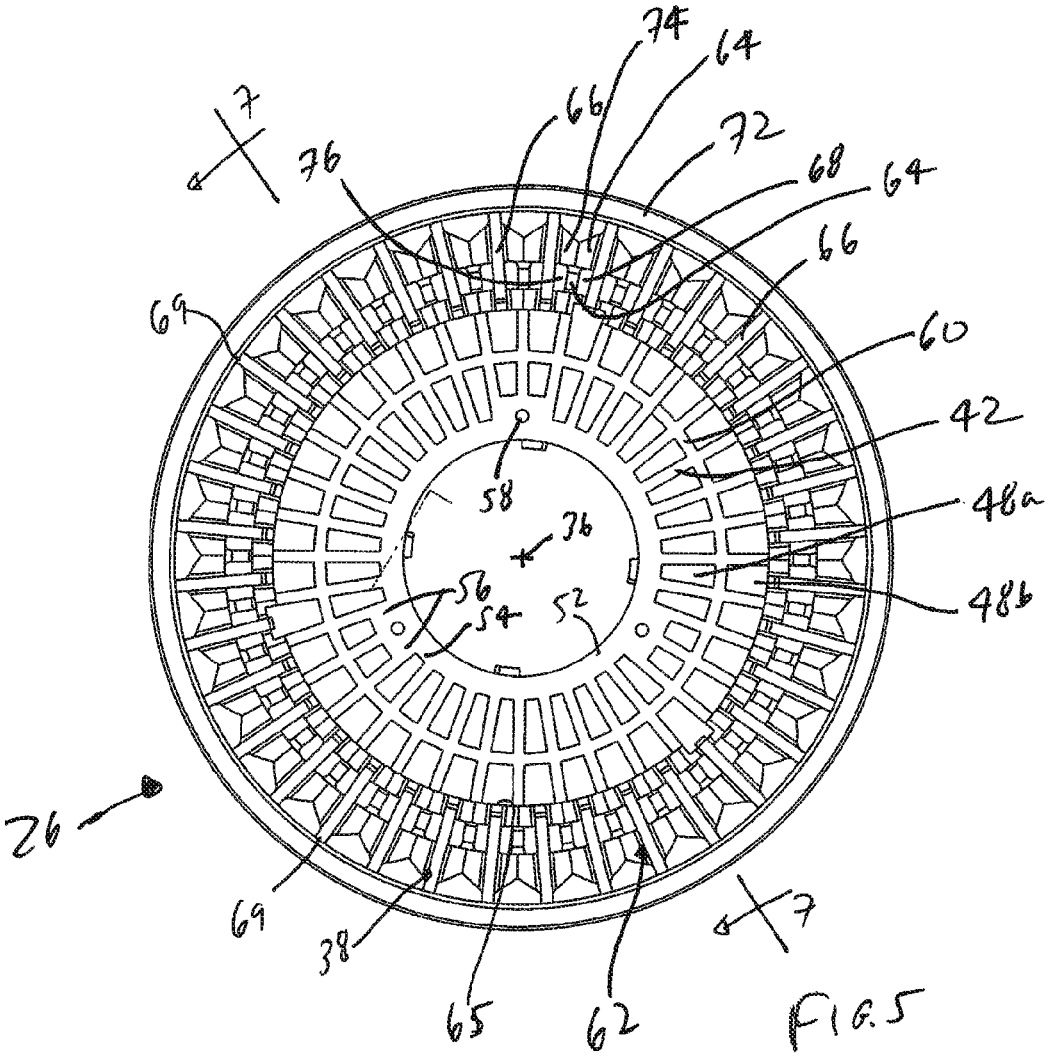
FIG. 5 is a top plan view of the heat sink of FIG. 3.

As best shown in FIG. 5, the top end 52 of the base 32 is thickened to form an inner ring 54. At equi-distantly spaced locations, filled-in areas 56 extend outwardly from the inner ring 54 between the upper sections 42 to provide an anchoring point with bores 58 therein for attachment of the heat spreader 28 and the thermal pad 30 (if provided) to the heat sink 26. As shown, an arcuate piece 60 is provided between adjacent upper sections 42 at positions which are spaced from the base 32 such that a ring is formed by the arcuate pieces 60 and the upper sections 42. This ring splits each vertical channel 48 into an inner section 48*a* and an outer section 48*b* at the top end 52 of the base 32.

The upper portion 62 of each fin 38 extends upwardly from the upper section 42 and is spaced from the base 32. As best shown in FIG. 6, each upper portion 62 includes a lower section 64 which extends at an angle relative to the upper section 42 and an upper section 66 which extends upwardly from the lower section 64. The upper section 66 and the upper section 42 are parallel to each other, but offset from each other. The outer surface of each upper portion 62 and the outer surface of the upper section 42 continues the curve of the upper section 42. The inner surfaces 65 of the lower and upper sections 64, 66 extend parallel to the centerline 36 and fall along a concentric circle. The upper end 67 of each upper section 66 is flat and is generally perpendicular to the inner surface 65.

An aperture 68 is provided through the lower section 64 which creates a flow path from the vertical channel 48 to a channel 70 (see FIG. 6) formed between adjacent upper sections 66. If desired and as shown in the drawings, the aperture 68 can extend upwardly from the lower section 64 into the upper section 66 to provide a larger air flow path. An outer ring 72, see FIGS. 5 and 6, is provided at the upper, outer ends 69 of the upper sections 66 to connect the upper sections 66 together.

As a result of the structure of the heat sink 26, a plurality of channels 48, 70 are formed by the fins 38 to allow air to circulate from the bottom end 50 of the base 32 to the upper ends 69 of the fins 38. The apertures 68 aid in providing efficient heat transfer along the heat sink 26, and thus providing a more homogeneous temperature across the fins 38, while minimizing the weight of the heat sink 26. In addition, the apertures 68 promote turbulence in the air, as the air is circulated through the heat sink 26 which aids in heat dissipation by the heat sink 26.

If desired and as shown in the drawings, a secondary lower section 74 can be provided to connect the upper section 66 of each fin 38 to the upper section 42 of the adjacent fin 38. The secondary lower section 74 is angled relative to the lower section 64 and relative to the upper section 42. If such a secondary lower section 74 is provided, an aperture 76 may be provided through the secondary lower section 74 to form an additional flow path from the vertical channel 48 to the channel 70 formed between adjacent upper sections 66, and a separate channel 78, FIG. 4, is formed between the lower sections 64, 74, the upper sections 66 and the ring 72. Therefore, if the secondary lower sections 74 are provided, as shown in FIG. 6, a Y-shape is generally formed by the upper section 42, the lower section 64 and the upper section 66 of one fin 38 and the secondary lower section 74 and the upper section 66 of the adjacent fin 38. While Y-shapes are shown with a sharp corner, it is to be understood that these corners could be rounded such that a U-shape is formed, or the lower sections 66, 74 could be horizontal such that a T-shape is formed.

Figure 8:
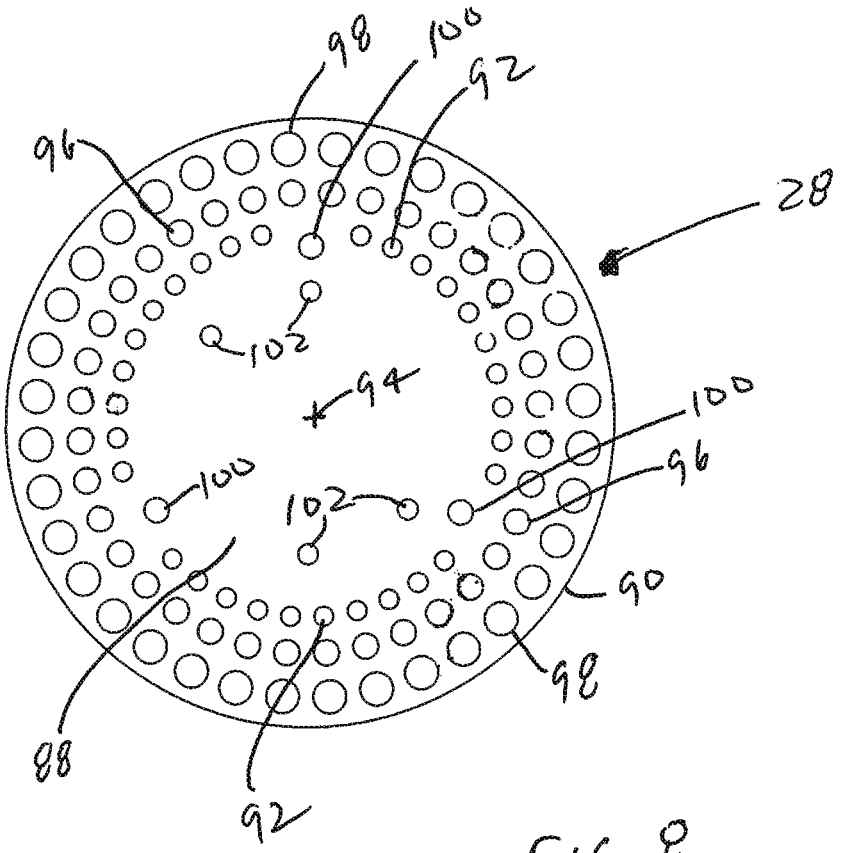
FIG. 8 is a bottom plan view of a heat spreader used in the lamp of FIG. 1.

As shown in FIG. 8, the heat spreader 28 includes a plate 88 which has an outer circular edge 90 that conforms to the shape of the common circle upon which the inner surface 43 of each upper section 42 falls along. The heat spreader 28 includes a first row of apertures 92 which are concentrically aligned and radially spaced from a centerline 94 of the heat spreader 28, a second row of apertures 96 which are equidistantly spaced from each other and concentrically aligned and radially spaced from the centerline 94 of the heat spreader 28, and a third row of apertures 98 which are equidistantly spaced from each other and concentrically aligned and radially spaced from the centerline 94 of the heat spreader 28. The first row of apertures 92 are closest to the centerline 94, the second row of apertures 96 are positioned radially outwardly from the apertures 92 in the first row, and the third row of apertures 98 are positioned radially outwardly from the apertures 96 in the second row. The third row of apertures 98 are proximate to, but spaced from, the edge 90. The apertures 92 in the first row are divided into three sets. In each set, the apertures 92 are equidistantly spaced from each other. Between each set of apertures 92 in the first row, a through hole 100 is provided through the plate 88 into which a fastener is attached for attaching the LED assembly 22 to the heat sink 26. As shown, the size of the apertures 92, 96, 98 increase from the first set to the second set and from the second set to the third set. A plurality of through holes 102 are provided through the plate 88 inwardly of the first set of apertures 92 for attachment of the LED assembly 22 to the heat spreader 28. The heat spreader 28 is thin and thermally conductive, and can be formed out of materials such as copper or aluminum or any other material with high thermal conductivity that can help provide a low thermal resistivity between the LED assembly 22 and an exterior edge of the heat sink 26, which in an embodiment can be less than two (2) degrees Celsius per watt (C/W).

The heat spreader 28 may have a thickness (from the top surface (which abuts the LED assembly 22)) to the bottom surface (which is proximate to the heat sink 26)) which is greater than 0.5 mm. For most applications, it has been determined that when high thermal conductivity materials (e.g., materials with a thermal conductivity of greater than 100 W/m-K) are used for the heat spreader 28, there are reduced benefits to having the heat spreader 28 be greater than about 1.2 mm thick and having a thickness of less than 1.5 mm can be beneficial from a weight standpoint. That being noted, for certain higher wattage applications (e.g., greater than 12 watts) a thicker heat spreader 28 may still provide some advantages.

Figure 9:
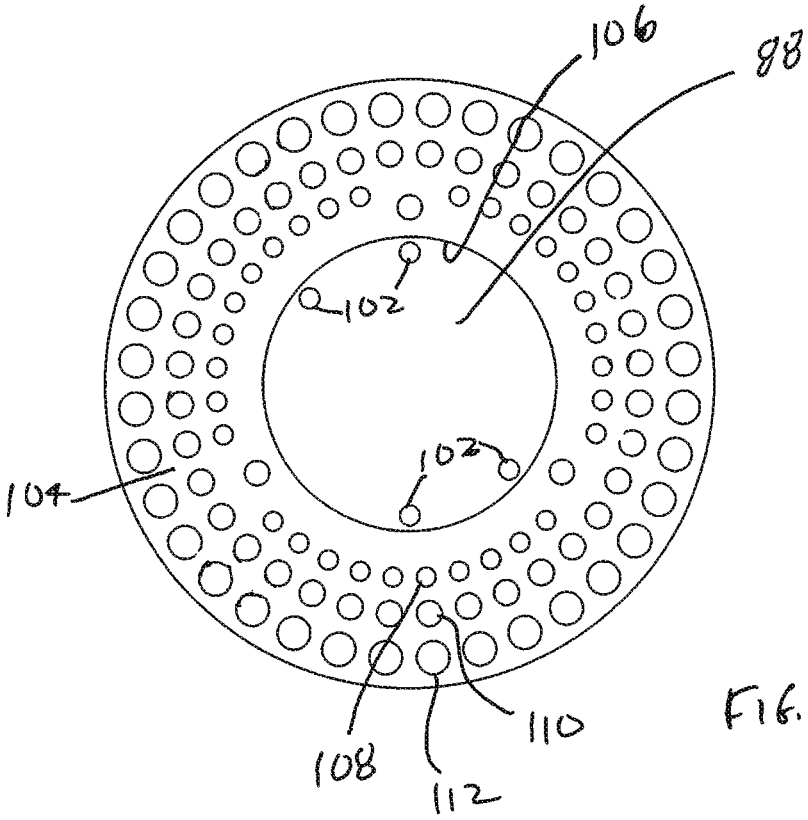
FIG. 9 is a bottom plan view of the heat spreader of FIG. 8 having a thermal pad attached thereto.
Figure 10:
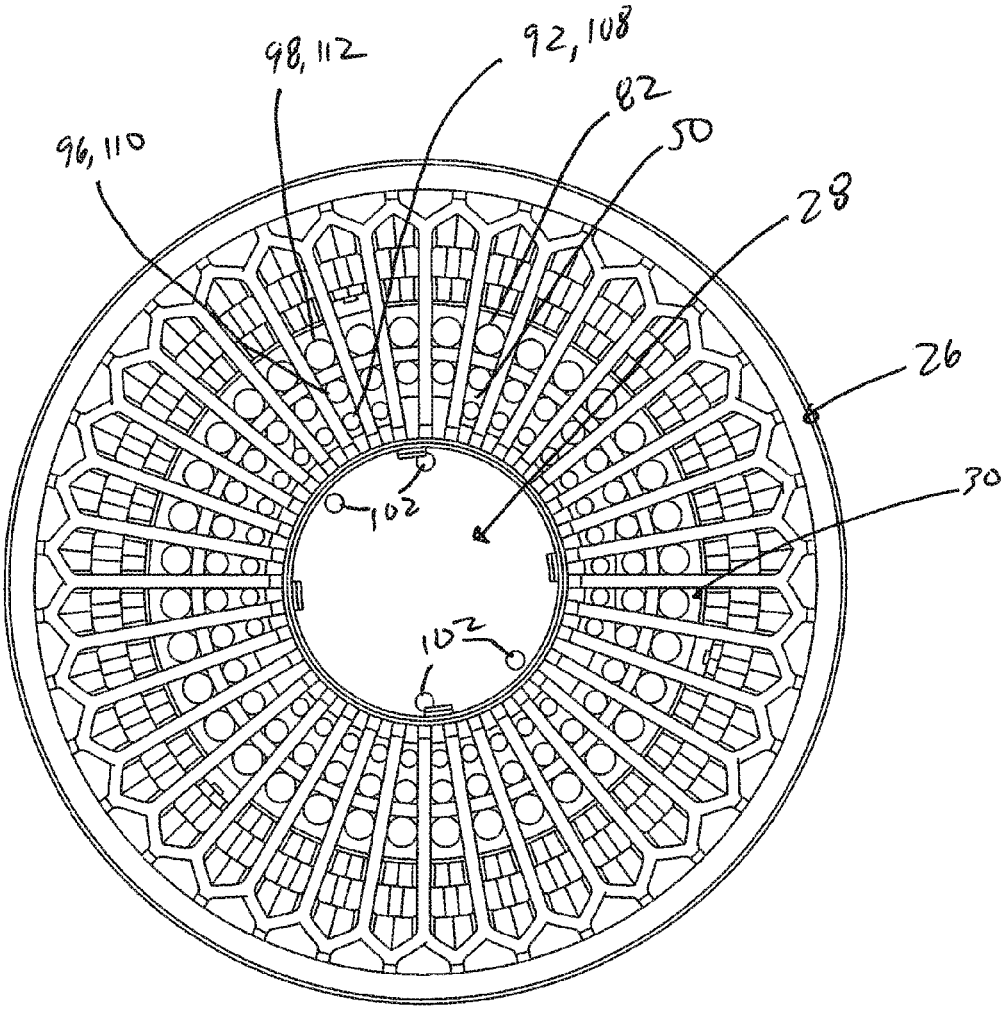
FIG. 10 is a bottom plan view of the heat sink, heat spreader and thermal pad of FIGS. 3-9.

As shown in FIG. 9, a thermal pad 30 (which is not necessary, but is preferred) is mounted to one side of the heat spreader 28 and is provided between the heat sink 26 and the heat spreader 28. The thermal pad 30 can be a thermally conductive adhesive gasket such as, for example, 3M's Thermally Conductive Adhesive Transfer Tape 8810, and can be cut/stamped to the desired shape from bulk stock and applied in a conventional manner. As shown, the thermal pad 30 is a ring-shaped body 104 which defines a central aperture 106 therethrough. The thermal pad 30 includes a first row of apertures 110 which align with and conform in shape to the first row of apertures 92 through the heat spreader 28, a second row of apertures 110 which align with and conform in shape to the second row of apertures 96 through the heat spreader 28, and a third row of apertures 112 which align with and conform in shape to the third row of apertures 98 through the heat spreader 28. The through holes 102 in the heat spreader 28 are positioned adjacent to the central aperture 106 of the thermal pad 30. The thermal pad 30 has a thickness and it is desirable to reduce the thickness where possible as the thermal pad 30, if a thermally efficient system is desired, tends to have a thermal conductivity that is more than one order of magnitude less than the thermal conductivity of the heat spreader 28. In an embodiment, the thickness of the thermal pad 30 can be about or less than 1.0 mm and in other embodiments may be less than 0.5 mm thick.

The heat spreader 28/thermal pad 30 seat on the inner ring 54, the filled-in areas 56, the upper sections 42 and the arcuate pieces 60. The apertures 96/110, 92/108 in the first and second rows align with the channels 48*a* of the heat sink 26. The apertures 98/112 in the third row align with the channels 48*b* of the heat sink 26. Through holes 100 align with the bores 58 in areas 56 and fasteners, which may be conventional screws or a push-pin type connector or some other fastener, are provided therethrough to firmly couple the heat spreader 28/thermal pad 30 to the heat sink 26. The central aperture 106 of the thermal pad 30 is sized to conform in shape to the central passageway 34 through the base 32 of the heat sink 26. As a result, the heat spreader 28 and the heat sink 26 have a substantial area of overlap. Naturally, with all other things equal, increasing the area will tend to help reduce thermal resistivity between the heat spreader 28 and the heat sink 26. Since the thermal pad 30 is thin and has a relatively high thermal conductivity, then even areas of overlap that are only 3 or 5 times the size of the LED in the LED assembly 22 may be sufficient to provide a thermal resistivity between the LED in the LED assembly 22 and the heat sink 26 that is sufficiently low.

Figure 2:
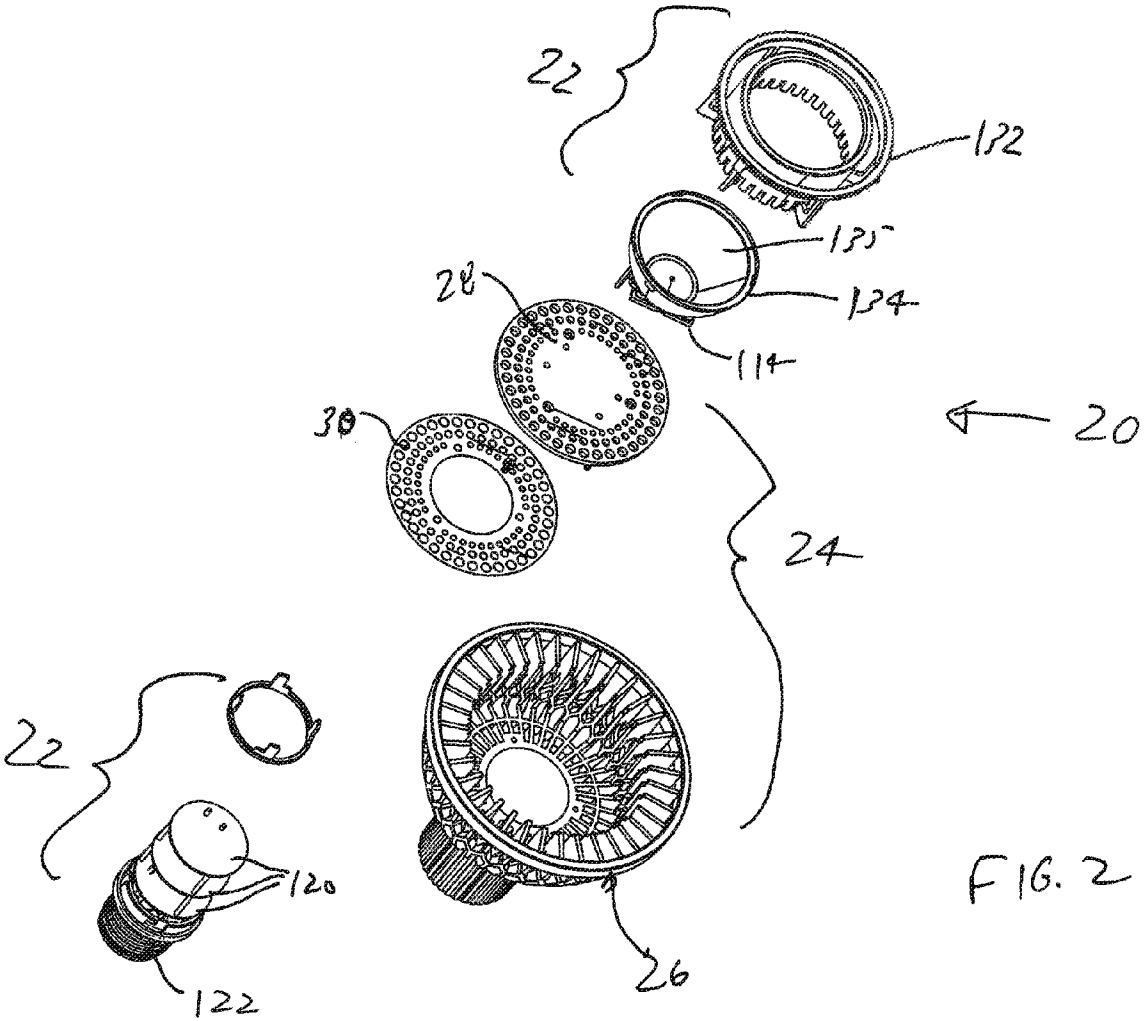
FIG. 2 is an exploded perspective view of the components of the lamp of FIG. 1.
Figure 3:
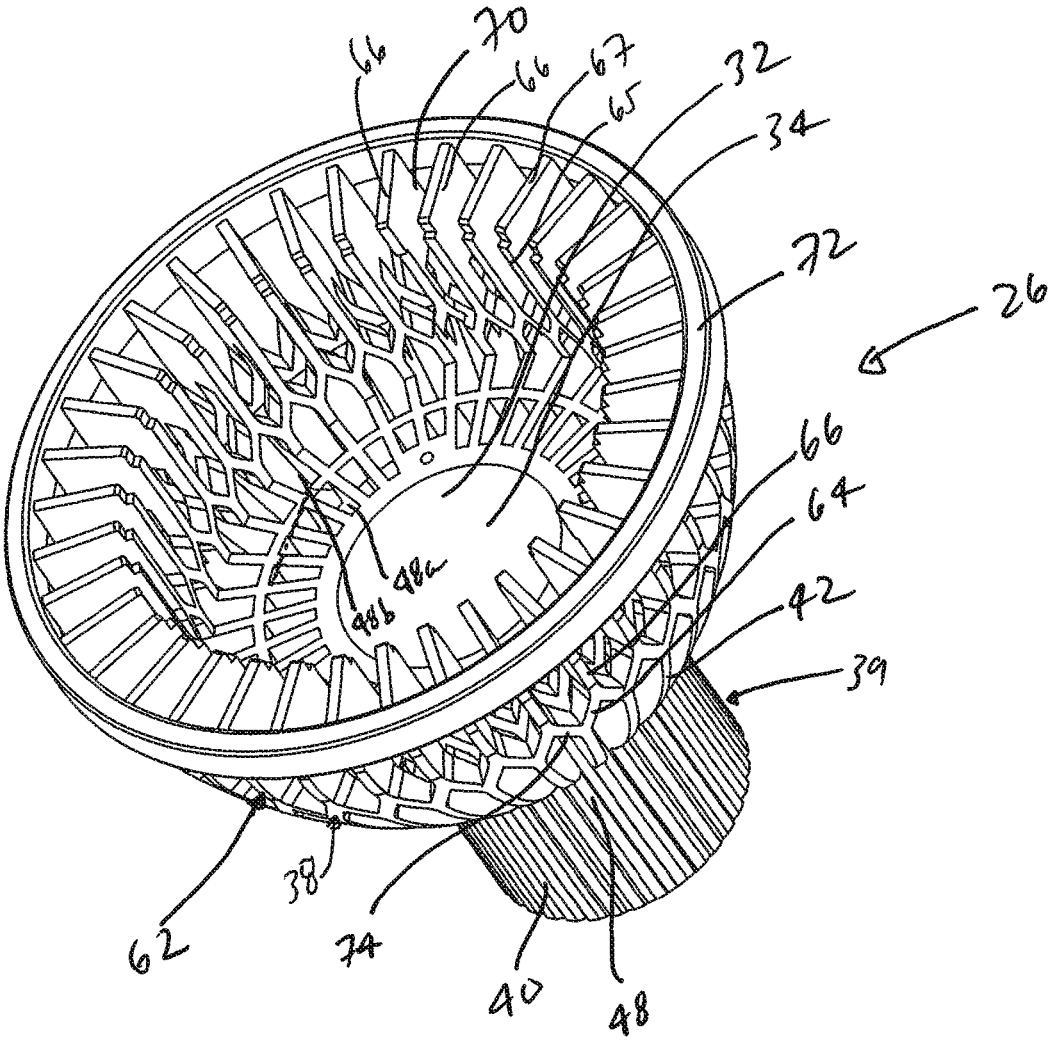
FIG. 3 is a perspective view of a heat sink used in the lamp of FIG. 1.
Figure 11:
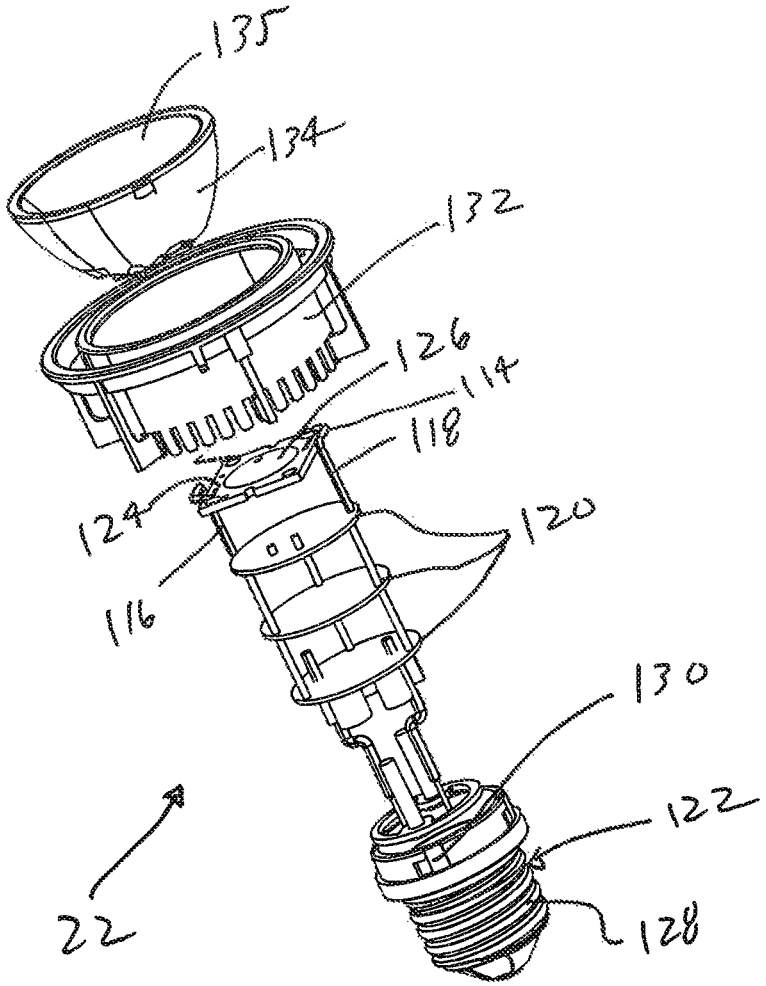
FIG. 11 is an exploded perspective view of a LED assembly used in the lamp of FIG. 1.

As shown in FIGS. 2 and 11, the LED assembly 22 includes an LED module 114, an anode and cathode 116, 118 which are connected to the LED module 114 and to a series of boards 120 (which may each be formed of a conventional printed circuit board or can be traces provided on dielectric layer), and a base assembly 122.

As best shown in FIG. 11, the LED module 114 includes an insulative base 124, a LED seated on the base 124, and a LED cover 126 seated on the base 124 and covering the LED. The LED may be a single LED or an array. The base 124 houses electronics. A plurality of apertures are provided through the base 124. The anode and cathode 116, 118 are connected to the LED and extend through the base 124 and connect to the uppermost board 120. A heat puck or a phase change pad may be provided on the underside of the base 124. The heat puck/phase change pad may be a conductive element that is integrated into the LED module 114 and attached thereto by a thermally conductive epoxy. In an alternative embodiment, the heat puck/phase change pad can be a dispensed conductive material, such as (without limitation) a thermally conductive epoxy or solder.

The LED module 114 seats on the upper surface of the heat spreader 28 such that the heat puck/phase change pad, if provided, contacts the heat spreader 28. The heat spreader 28 is thus positioned between the underside of the LED module 114 and the heat sink 26. The heat spreader 28 abuts the underside of the LED module 114 (or the heat puck if provided) such that the LED is thermally coupled to the heat spreader 28. The anode and cathode 116, 118 extend through two of the apertures 102 in the heat spreader 28 and through the central passageway 106 of the thermal pad 30 for connection to the uppermost board 120.

The boards 120, which as shown are three in number, are positioned below and spaced from the base 124 of the LED module 114. The boards 120 house electronics and are electrically coupled to the base assembly 122 and to the anode and cathode 116, 118. The electronics on the boards 120 may provide AC to DC conversion for the LED module 114. The boards 120 are typically enclosed or potted in potting material (not shown) and are seated within the central passageway 34 of the base 32 of the heat sink 26.

One or more LEDs can be used in the LED module 114 to provide an LED array and the LED(s) can be design to be powered by AC or DC power. The advantage of using AC LEDs is that there is no need to convert conventional AC line voltage to DC voltage. This can be advantageous when cost is a significant driver as the power convertor circuit either tends to be expensive or less likely to last as long as the LED itself can last. Therefore, to get the expected 30,000 to 70,000 hours from a LED fixture, the use of AC LEDs can be beneficial. For applications where there is an external AC to DC conversion (e.g., for applications where it is undesirable to have line voltage), however, DC LEDs may provide an advantage as existing DC LEDs tend to have superior performance. It should be noted that if a LED array is configured for low thermal resistance between the LED array and a mating interface that would engage a heat spreader or heat sink, the system tends to be more effective. An LED array such as available from Bridgelux would be suitable (in an embodiment, for example, the thermal resistance between the LED array and the heat spreader can be less than one and one half (1.5) degrees Celsius per watt and in an embodiment can be less than one (1) degree Celsius per watt if a highly thermally efficient LED array is used). Furthermore, if controls are desired to improve dimming capability or to reduce susceptibility to noise on the power line, then the use of DC LEDs may provide a system that has a comparable cost of a system using AC LEDs.

The base assembly 122 is electrically connected to the lowermost board 120. The base assembly 122 includes an Edison base 128 and a dielectric ring 130 which electrically isolates the Edison base 128 from the heat sink 26. The LED assembly 22 further includes a dielectric housing 132, a reflector 134 mounted within the housing 132, and a lens cover 135 mounted on an upper end of the reflector 134.

Figure 12:
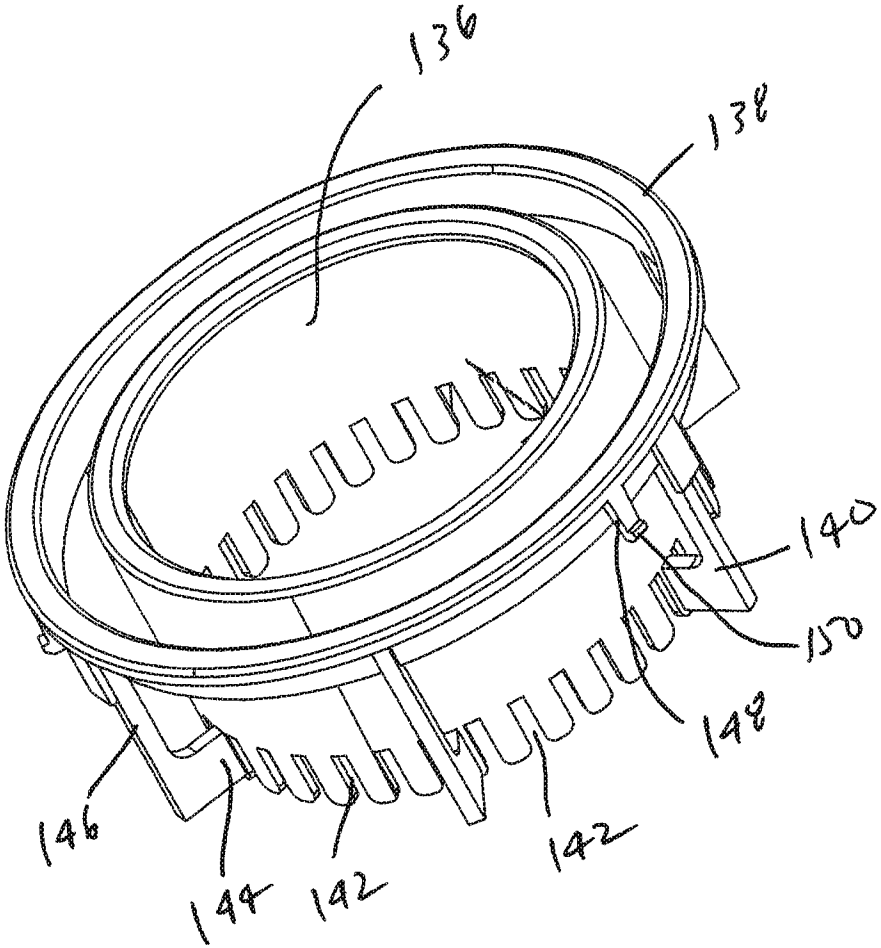
FIG. 12 is a top perspective view of a housing used in the lamp of FIG. 1.

As best shown in FIG. 12, the housing 132 is formed from an inner ring 136 which is attached to an outer ring 138 by a plurality of L-shaped braces 140. The inner ring 136 has a height which is greater than the height of the outer ring 138. The inner and outer rings 136, 138 have a top surface which falls in the same plane. The lower end of the inner ring 136 has a plurality of equi-distantly spaced notches 142 which extend upwardly from the bottom end thereof. Each brace 140 has a first leg 144 which extends radially outwardly from the lower end of the inner ring 136, and a second leg 146 which extends perpendicular to the first leg 144 upwardly to the outer ring 138. A plurality of snap-fit arms 148 having a barb 150 at its free end extend downwardly from the outer ring 138 for engagement with a shoulder formed in predetermined ones of the upper sections 66 of the heat sink 26. In use, the housing 132 seats on top of the heat spreader 28 and within the heat sink 26. If desired, the housing 132 can be integrally formed with the heat sink 26, with the housing 132 being formed in a non-plateable first shot of the heat sink 26 when the heat sink 26 is formed by two-shot molding.

The reflector 134, see FIG. 11, is formed by an open-ended wall having a lower aperture and an upper aperture. The lower aperture is shaped like the LED cover 126. The wall includes an inner surface which is angled and has its largest diameter at its upper end and tapers inwardly. The reflector 134 is mounted on the base 124 of the LED module 114 by suitable means such that the LED cover 126 is positioned within the lower aperture of the reflector 134. The upper end of the wall provides an illumination face. The reflector 134 can be thermally conductive (e.g., can be provided with a thermally conductive plating). The lens 135 is secured within the upper aperture. The housing 132 surrounds the reflector 134. The notches 142 in the housing 132 allow heat from the reflector 134 and the LED module 114 to radiate outwardly.

When the LED in the LED module 114 is being driven, the current passing through the LED generates heat that is passed to the heat puck (if provided), then the heat puck transfer heat to the heat spreader 28. The heat then passes to the heat sink 26 and heat spreads outwardly to the fins 38. The apertures 68, 96/110, 92/108, 98/112 and the channels 48, 70 (and apertures 76 and channels 78 if provided) provide effective heat transfer passages to conduct heat such that heat can be dissipated over the length of the fins 38. As a result, when a plated plastic is used for the heat sink 26, the heat is effectively dissipated over the entire heat sink 26.

The heat puck (if used) and the heat spreader 28 can be configured so as to have sufficient high thermal conductivity so as to be substantially irrelevant to the thermal resistivity of the lamp 20. For example, the heat puck can be soldered to the heat spreader 28 and as the solder tends to have a thermal conductivity of greater than 15 W/mK and is layered relatively thin, it tends to not be a significant factor is transferring heat away from the LED. Furthermore, as the heat puck (if used) and the heat spreader 28 tend to be made of materials with high thermal conductivity (typically greater than 50 W/mK), there tends to be very little thermal resistance between the heat puck and the outer edge of the heat spreader 28. It should be noted that the heat spreader 28 is exposed to the lens 135 and therefore it can be beneficial that any exposed surface of the heat spreader 28 be reflective. In an embodiment the heat spreader 28 may have a reflective layer adhered to the exposed surface. In another embodiment, the exposed surface of the heat spreader 28 can be coated so as to provide the desired reflectivity.

Figure 13:
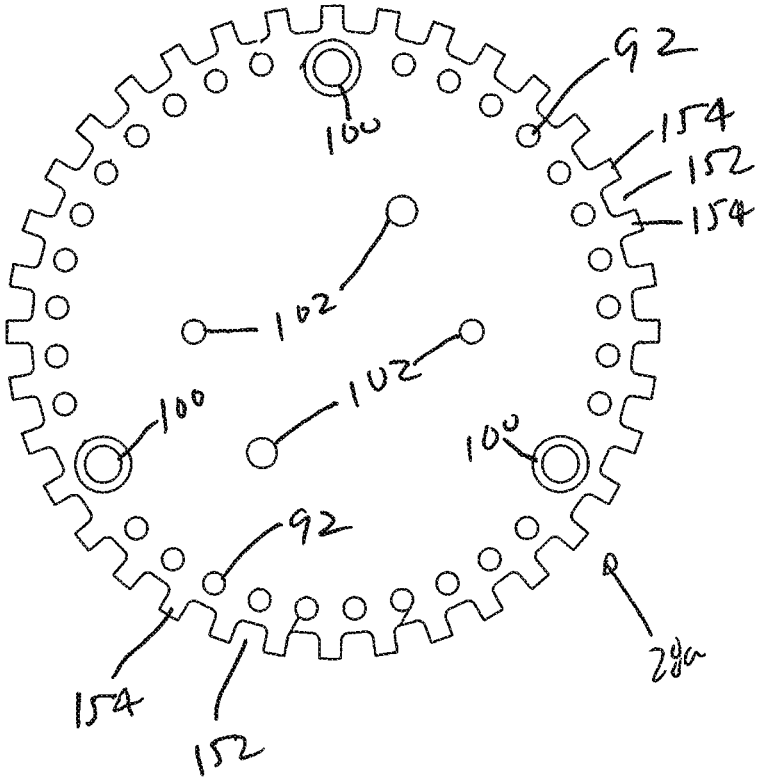
FIG. 13 is a top plan view of an alternate heat spreader used in the lamp of FIG. 1.
Figure 14:
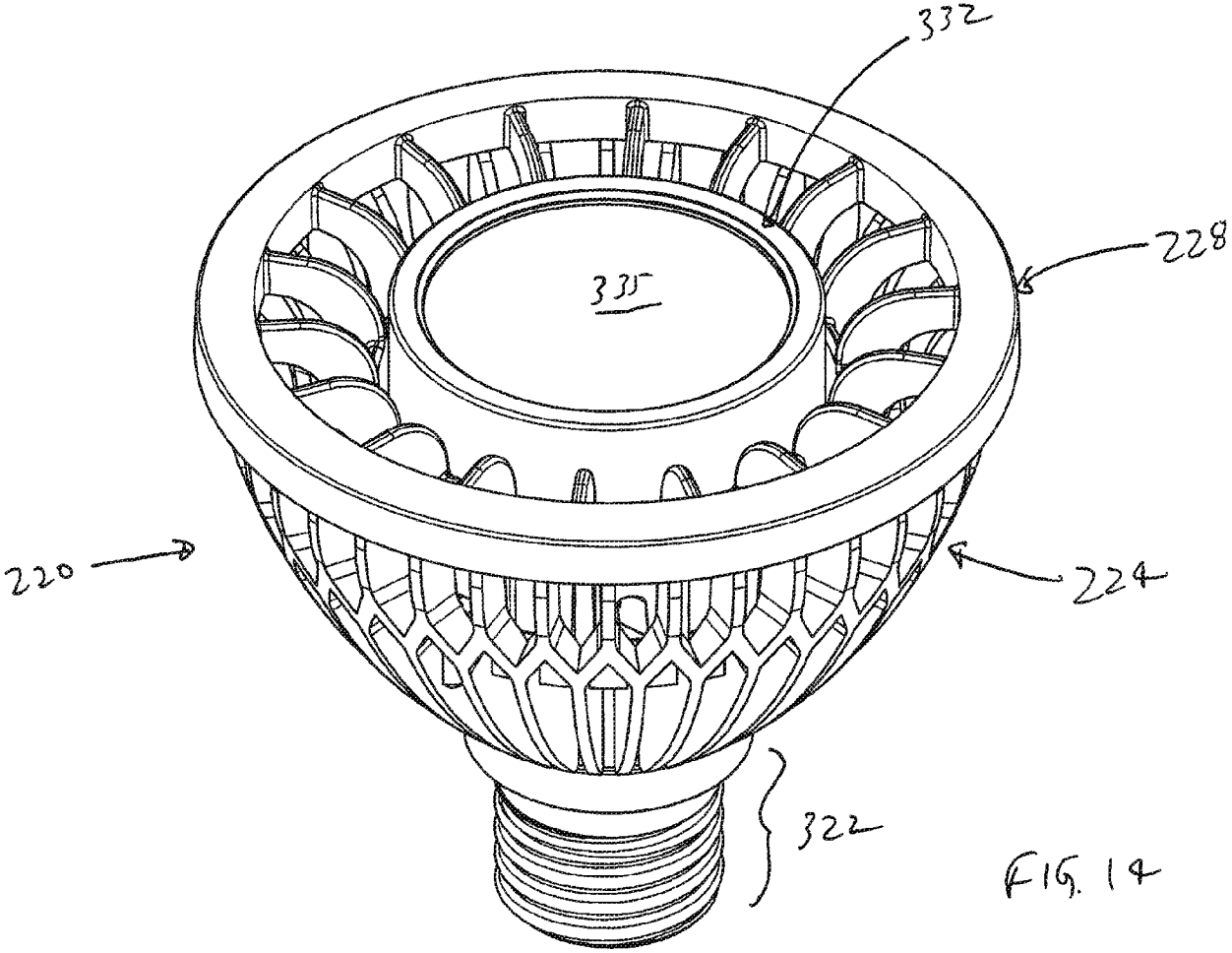
FIG. 14 is a top perspective view of another embodiment of a lamp.
Figure 15:
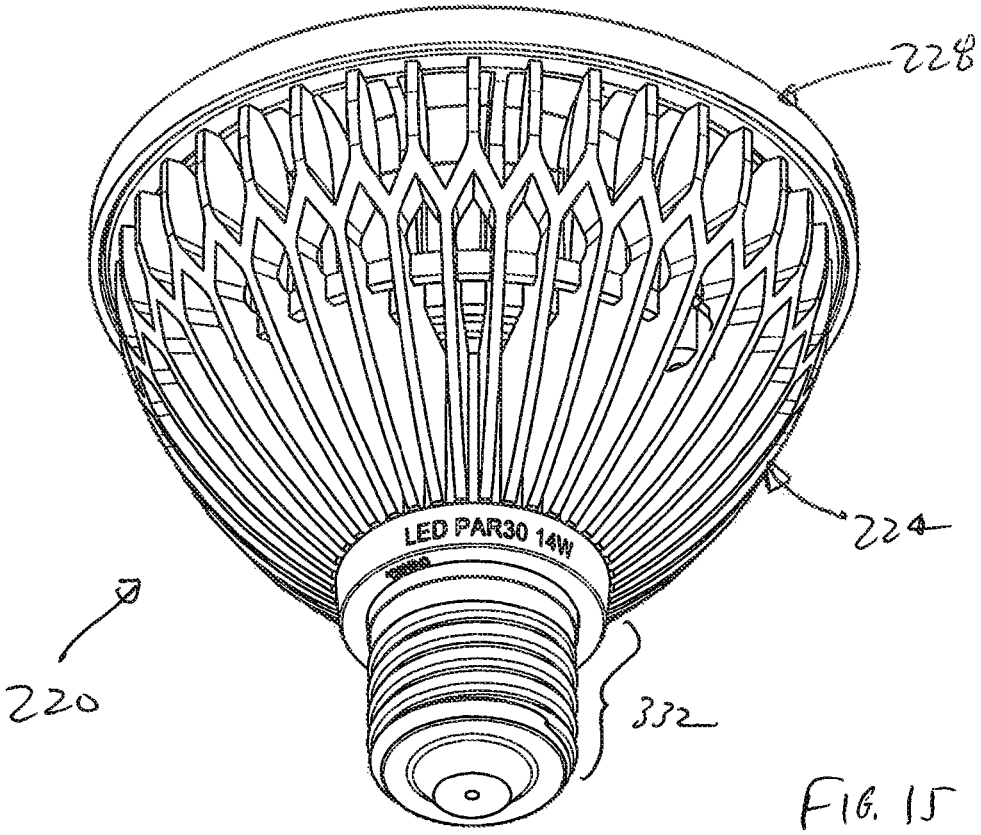
FIG. 15 is a bottom perspective view of the lamp of FIG. 14.

As shown in FIG. 13, the heat spreader 28 can be modified to replace the second and third rows of apertures 96, 98 with notches 152. The notches 152 form spoke-like fingers 154. The fingers 154 generally conform to the shape of the upper surfaces of the upper sections 42 of the fins 38 which are inwardly of the upper portions 62 of the fins 38.

Figure 19:
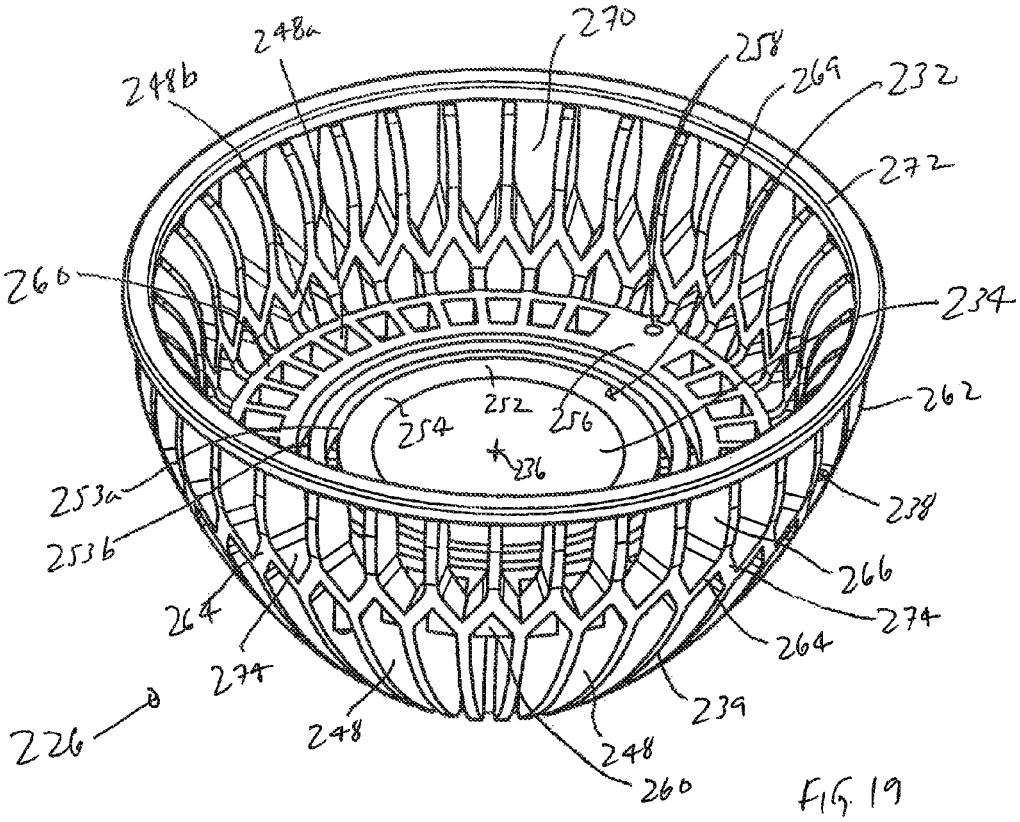
FIG. 19 is a perspective view of a heat sink used in the lamp of FIG. 14.

Attention is invited to the embodiment of the heat sink assembly 224 shown in FIGS. 14-22. As best illustrated in FIG. 19, the heat sink 226 includes a cylindrical base 232 having a central passageway 234 therethrough which defines a centerline 236. A plurality of spaced-apart, elongated fins 238 extend from the base 232. Each fin 238 has a lower portion 239 which extends outwardly from the base 232 and an upper portion 262 which extends upwardly from a mounting surface 232*a* of the base 232. As can be appreciated from FIG. 21, therefore, the upper portion of the fins extends upwardly in a first direction A and the fins of the heat spreader also extend in the first direction, however the fins of the heat spreader extend further in the first direction A. In addition, some of the fins of the heat sink 226, compared to the location of the plate 288, extend in a second direction B that is opposite the first direction A.

Figure 21:
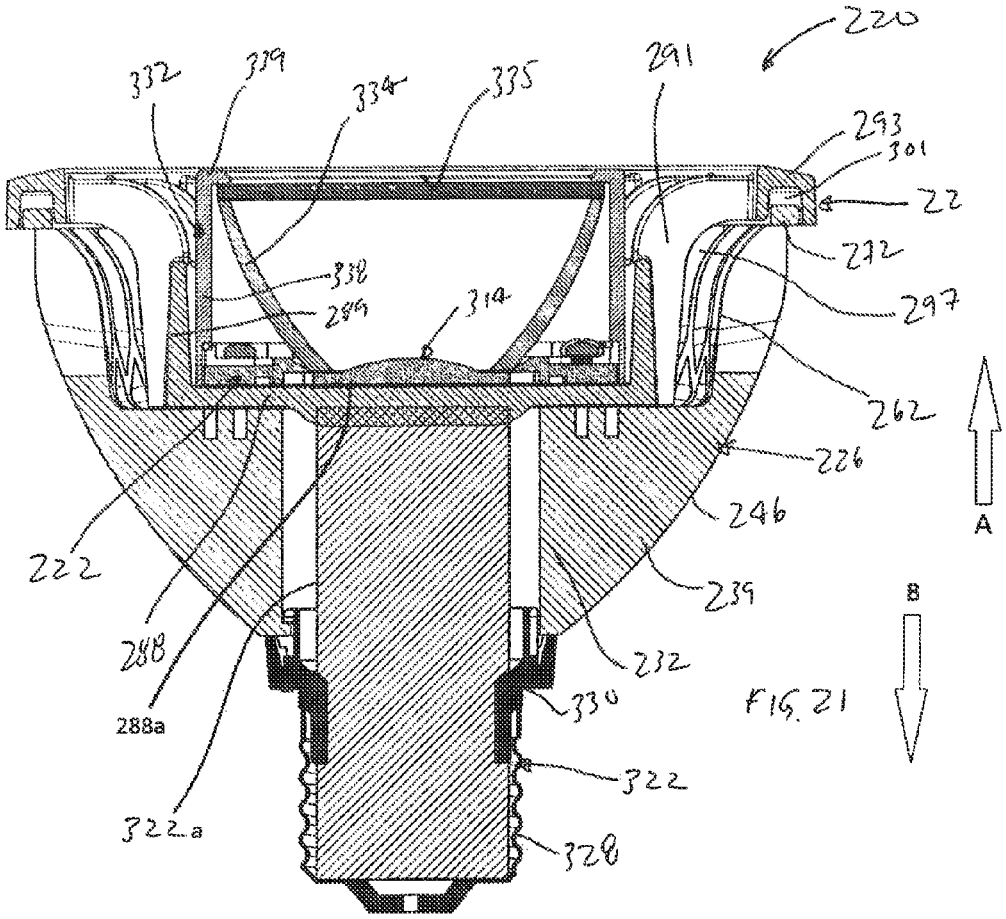
FIG. 21 is a cross-sectional view of the lamp along line 21-21 of FIG. 16.

As best shown in FIG. 21, the lower portion 239 of each fin 238 extends radially outwardly from the base 232. Each lower portion 239 has an outer edge 246 which curves outwardly from the base 232. As a result, vertical channels 248, FIG. 19, are formed between adjacent lower portions 239 and extend below the mounting surface 232*a*. As shown, an arcuate piece 260 is provided between adjacent lower portions 239 at positions which are spaced from the base 232 such that a circular ring having an outer circumference 243 is formed by the arcuate pieces 260 and the lower portions 239. This ring splits each vertical channel 248 into an inner section 248*a* and an outer section 248*b* at the top end 252 of the base 232.

The top end 252 of the base 232 is thickened to form an inner ring 254, FIG. 19. At equi-distantly spaced locations, filled-in areas 256 extend outwardly from the inner ring 254 to provide an anchoring point with bores 258 therein for attachment of the heat spreader 228 and the thermal pad (if provided) to the heat sink 226. A pair of circular grooves 253*a*, 253*b* extend downwardly a predetermined distance from the top end 252 of the base 232.

The upper portion 262 of each fin 238 extends upwardly from the lower portion 239 and is spaced from the base 232. Each upper portion 262 includes a lower section 264 which extends at an angle relative to the lower portion 239 and an upper section 266 which extends upwardly from the lower section 264. The upper section 266 and the lower portion 239 are parallel to each other, but offset from each other. The outer surface of each upper portion 262 continues the curve of the lower portion 239. The inner surfaces 265 of the lower and upper sections 264, 266 curve upwardly and outwardly relative to the centerline 236 of the base 232. A channel 270 is formed between adjacent upper sections 266. An outer ring 272 is provided at the upper, outer ends 269 of the upper sections 266 to connect the upper sections 266 together. As a result of the structure of the heat sink 226, a plurality of channels 248, 270 are formed by the fins 238 to allow air to circulate from the bottom end 250 of the base 232 to the upper ends 269 of the fins 238.

Figure 16:
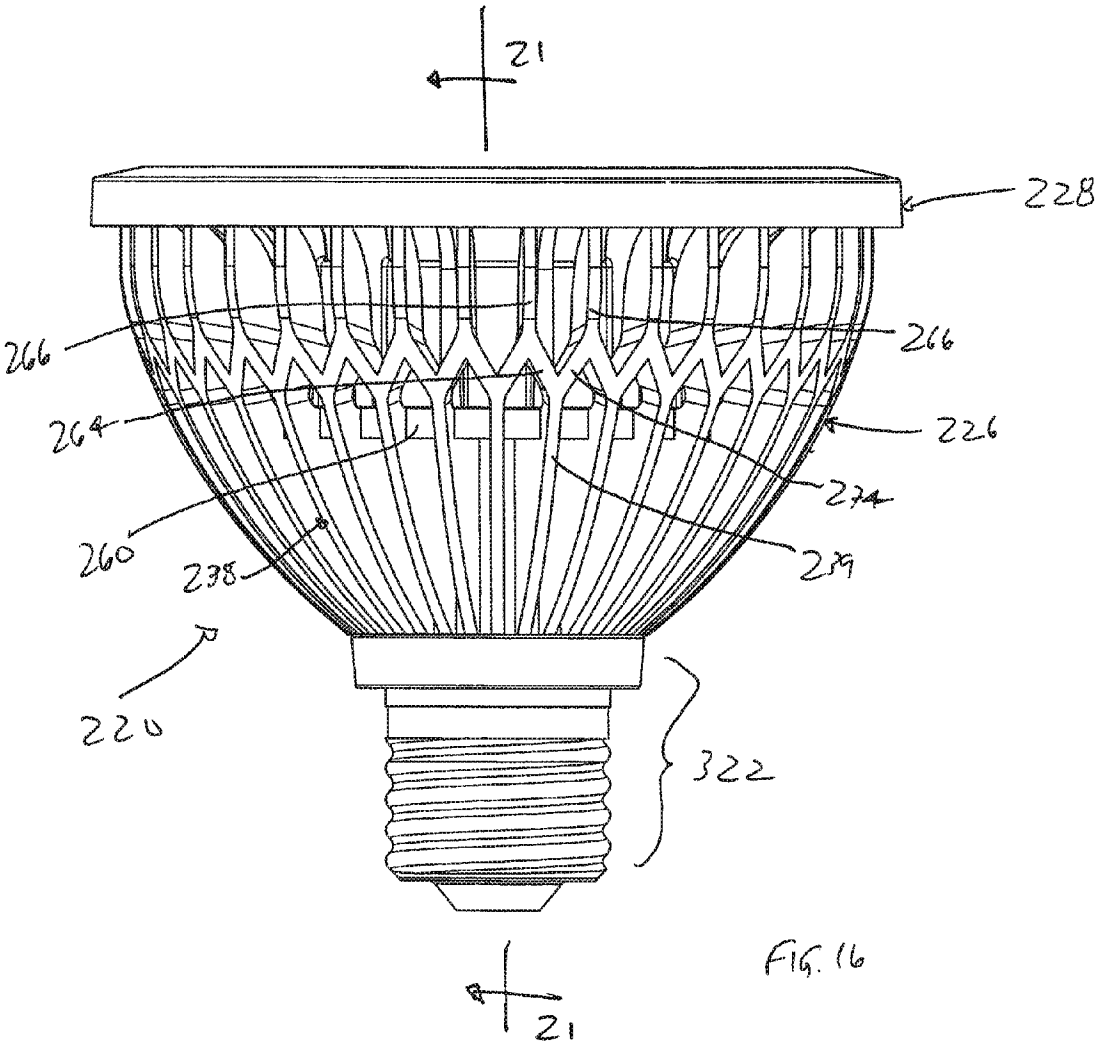
FIG. 16 is a side elevational view of the lamp of FIG. 14.

If desired and as shown in the drawings, a secondary lower section 274 can be provided to connect the upper section 266 of each fin 238 to the lower portion 239 of the adjacent fin 238. The secondary lower section 274 is angled relative to the lower section 264 and relative to the upper section 242. Therefore, if the secondary lower sections 274 are provided, as shown in FIG. 16, a Y-shape is generally formed by the lower portion 239, the lower section 264 and the upper section 266 of one fin 238 and the secondary lower section 274 and the upper section 266 of the adjacent fin 238. While Y-shapes are shown with a sharp corner, it is to be understood that these corners could be rounded such that a U-shape is formed, or the lower sections 266, 274 could be horizontal such that a T-shape is formed.

Figure 20:
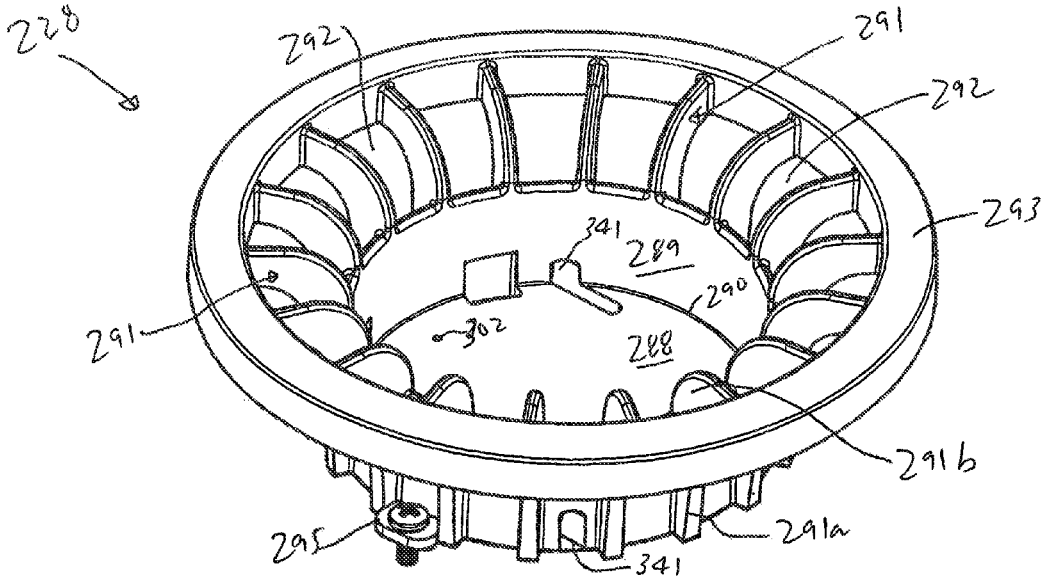
FIG. 20 is a perspective view of a heat spreader used in the lamp of FIG. 14.

As shown in FIG. 20, the heat spreader 228 includes a thin plate 288 which has an outer circular edge 290 that generally conforms to the shape of the outer circumference 243 of the ring. A circular wall 289 extends upwardly from the outer edge 290 of the plate 288 around its circumference. A plurality of spaced apart fins 291 extend from the wall 289. Each fin 291 has a first portion 291*a* extending along the height of the wall 289, and a second portion 291*b* which extends upwardly and outwardly from the upper end of the wall 289. The inner and outer surfaces of the second portion 291*b* of each fin 291 are curved. An upper ring 293 connects the upper ends of the second portions 291*b* together. As a result of this structure, a plurality of apertures 292 are formed between the upper end of the wall 289, the upper portions 291*b* of the adjacent fins 291 and the upper ring 293.

A pair of flanges 295 (only one of which is shown) extend outwardly from the outer wall 289 and have through holes provided therethrough into which a fastener is seated to attach the heat spreader 228 to the heat sink 226. A pair of through holes 302 are provided through the plate 288 for attachment of the LED assembly 222 to the heat spreader 228.

The heat spreader 228 is thermally conductive, and can be formed out of materials such as copper or aluminum or any other material with high thermal conductivity that can desirable shaped and can help provide a low thermal resistivity between the LED assembly 222 and the heat sink 226, which in an embodiment can be less than two (2) degrees Celsius per watt (C/W) and in an embodiment can be less than 1.5 degrees. The plate 288 of the heat spreader 228 may have a thickness (from the top surface 288*a* (which abuts the LED assembly 222)) to the bottom surface (which is proximate to the heat sink 226)) which is greater than 0.5 mm. For most applications, it has been determined that when high thermal conductivity materials (e.g., materials with a thermal conductivity of greater than 100 W/m-K) are used for the heat spreader 228, there are reduced benefits to having the heat spreader 228 be greater than about 1.2 mm thick and having a thickness of less than 1.5 mm can be beneficial from a weight standpoint. That being noted, for certain higher wattage applications (e.g., greater than 10 watts) a thicker plate 288 may still provide some advantages. As can be further appreciated, the heat spread extends forward of the plate 288 and thus can be valuable in helping provide improved thermal management in situations where the lamp is mounted in a recessed cavity (e.g., a down light application) because the heat spreader helps direct thermal energy toward an exit from the cavity.

Figure 22:
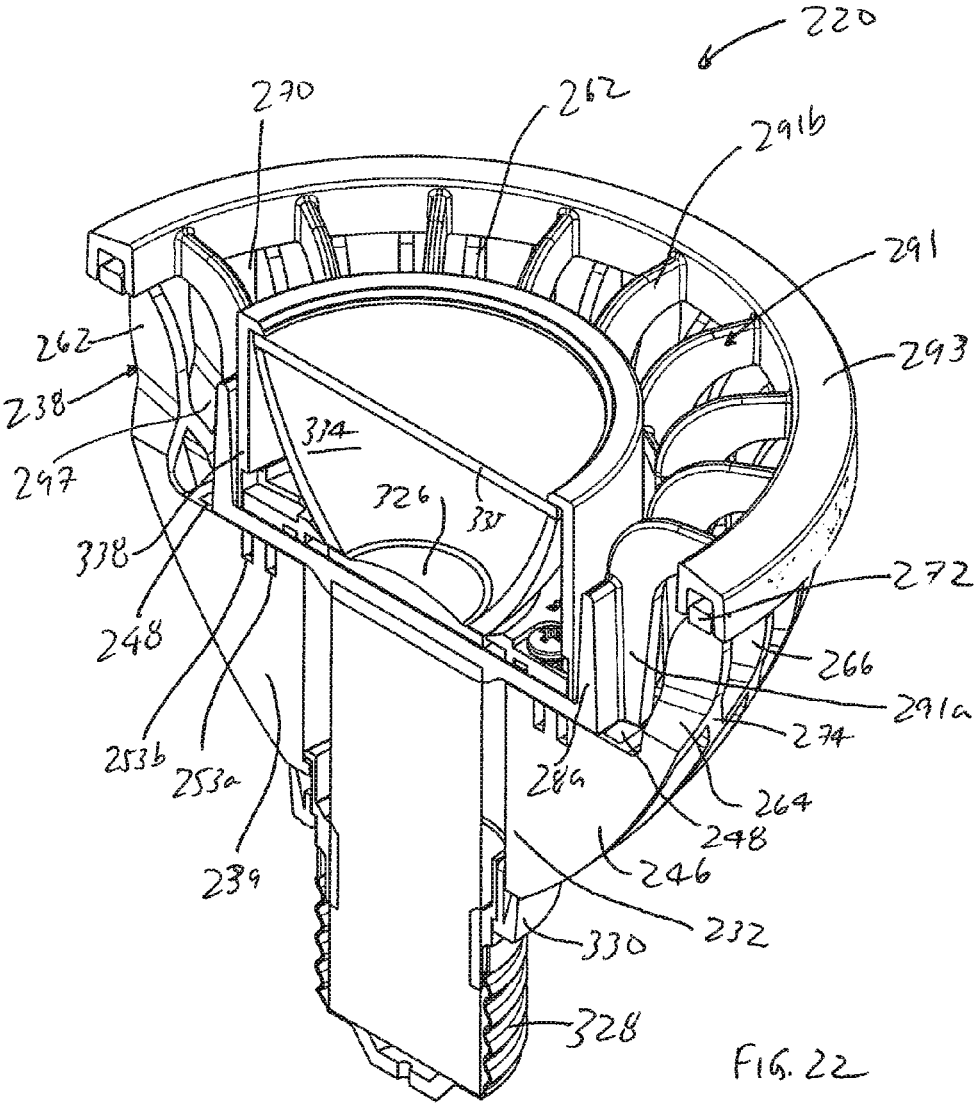
FIG. 22 is a perspective cross-sectional view of the lamp of FIG. 14.

A thermal pad (not shown) like that provided with the embodiment of FIGS. 1-12 may be mounted to one side of the heat spreader 228 and provided between the heat sink 226 and the plate 288 of the heat spreader 228. The plate 288/thermal pad can be seated on the top end 252 of the base 232 and the arcuate pieces 260. The fins 291 are proximate to, but spaced from the upper portions 262 such that channels 297, see FIGS. 21 and 22, are formed between the adjacent fins 291, the circular wall 289 and the upper portions 262. The outer ring 293 of the heat spreader 228 seats on the outer ring 272 of the heat sink 226 so as to at least partially occlude it and the outer ring 293 preferably has a recess 301 in which the outer ring 272 seats. If desired, a thermal gasket can also be provided along the interface between outer ring 272 and the outer ring 293 to help provide good thermal connection therebetween.

Figure 17:
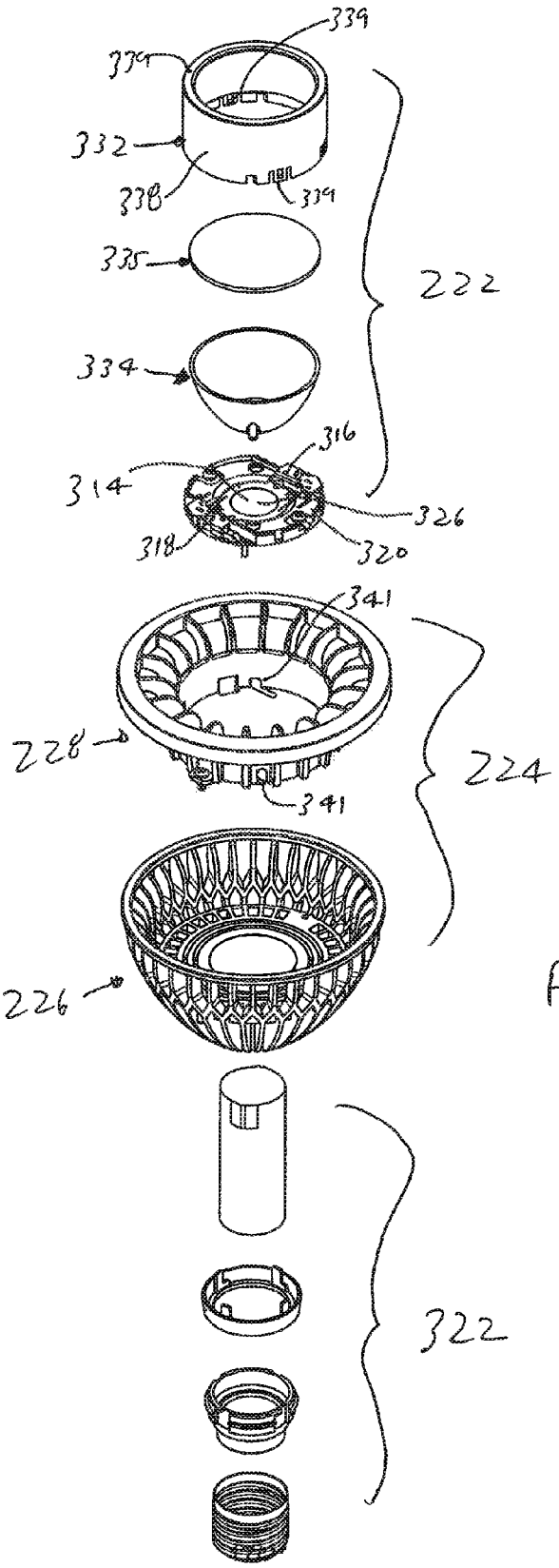
FIG. 17 is an exploded perspective view of the components of the lamp of FIG. 14.
Figure 18:
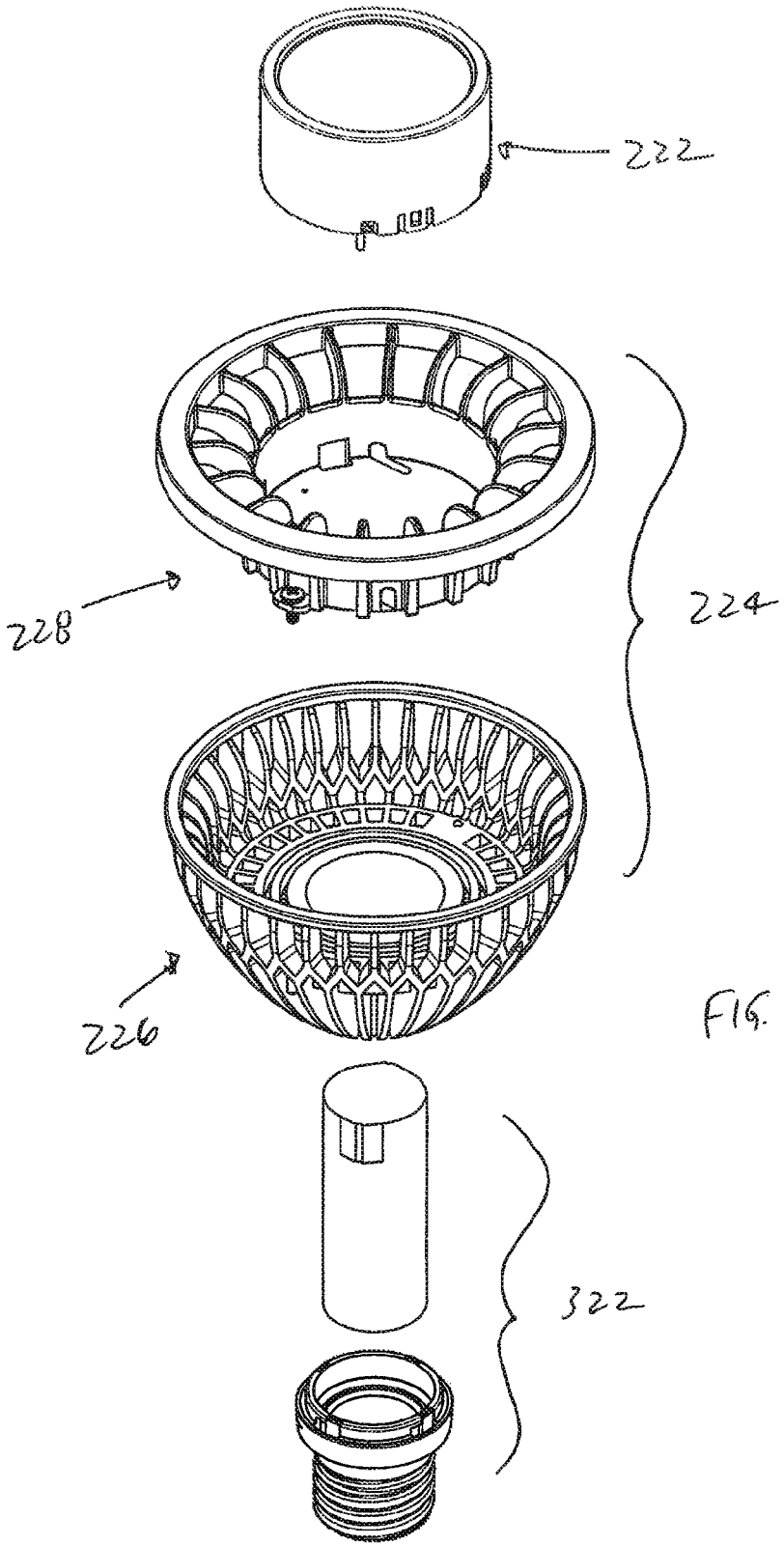
FIG. 18 is another exploded perspective view of the components of the lamp of FIG. 14 showing some of the components in an assembled state.

The LED assembly 222, FIG. 17, includes an LED module 314, an anode and cathode 316, 318 which are provided on a substrate 315 that supports the LED die and can include a board 320, and a base assembly 322. The LED module 314 includes an insulative base, a LED seated on the base, and a LED cover 326 seated on the base and covering the LED. The LED may be a single LED or an array. The base assembly 322 can house electronics (such as AC to DC conversion electronics and controls to address dimming) in block 322*a* and block 322*a* can be various desired controls and conversion circuitry that are supported by being potted in a thermally conductive yet electrically isolating material. The anode and cathode 316, 318 are connected to the LED and extend through the base and connect to the board 320. The board 320 can also support electronics and is electrically coupled to the base assembly 322 and to the anode and cathode 316, 318. The electronics on the board 320 may provide AC to DC conversion for the LED module 314.

As shown in FIG. 21, the LED module 314 seats on the upper surface of the plate 288 of the heat spreader 228. The heat spreader 228 is thus positioned between the underside of the LED module 314 and the heat sink 226. The heat spreader 228 abuts the underside of the LED module 314 such that the LED is thermally coupled to the heat spreader 228.

One or more LEDs can be used in the LED module 314 to provide an LED array and the LED(s) can be design to be powered by AC or DC power. The advantage of using AC LEDs is that there is no need to convert conventional AC line voltage to DC voltage. This can be advantageous when cost is a significant driver as the power convertor circuit either tends to be expensive or less likely to last as long as the LED itself can last. Therefore, to get the expected 30,000 to 70,000 hours from a LED fixture, the use of AC LEDs can be beneficial. For applications where there is an external AC to DC conversion (e.g., for applications where it is undesirable to have line voltage), or for situations where the drive is configured to be long lasting, however, DC LEDs may provide an advantage as existing DC LEDs tend to have superior performance. Furthermore, if dimming is desirable then a control circuit may be required and in such a situation the use of DC LEDs is more likely to be cost effective. It should be noted that if a LED array is configured for low thermal resistance between the LED array and a mating interface that would engage a heat spreader or heat sink, the system tends to be more effective. An LED array such as available from Bridgelux (in an embodiment, for example, the thermal resistance between the LED array and the heat spreader can be less than two (2) degrees Celsius per watt and in an embodiment can be less than one (1) degree Celsius per watt if a highly thermally efficient LED array is used) would be suitable.

The LED assembly 222 further includes a dielectric housing 332, a reflector 334 mounted within the housing 332, and a lens cover 335 mounted on an upper end of the reflector 334. As best shown in FIG. 17, the housing 332 is formed from an outer circular wall 338 and a top wall 339 which extends inwardly from the upper end of the wall 338. The lower end of the wall 338 has connectors, such as snap-fit arms 339, for positioning and connecting the housing 332 into suitable apertures 341 in the heat spreader 228. If the heat sink is formed of a composite structure that includes a plastic and a thermal coating as described below, the housing 332 can be integrally formed with the heat sink 226, with the housing 332 being formed in a non-plateable first shot of the heat sink 226 when the heat sink 226 is formed by two-shot molding.

The reflector 334 is formed by an open-ended wall having a lower aperture and an upper aperture. The lower aperture is shaped like the LED cover 326. The wall includes an inner surface which is angled and has its largest diameter at its upper end and tapers inwardly. The reflector 334 is mounted on the base of the LED module 314 by suitable means such that the LED cover 326 is positioned within the lower aperture of the reflector. The upper end of the wall provides an illumination face. The reflector 334 can be thermally conductive (e.g., can be provided with a thermally conductive plating). The lens 335 is secured within the upper aperture. The housing 332 surrounds the reflector 334.

The base assembly 322 is electrically connected to the board 320 and in an embodiment (as noted above, includes circuitry in the block 322*a*). The base assembly 322 includes an Edison base 328 and a dielectric ring 330 which electrically isolates the Edison base 328 from the heat sink 226. The dielectric ring 330 can be formed of two components which are removably coupled together by a suitable connection, such as a bayonet attachment. It should be noted that while the block 322*a* (which can be any shape suitable to be positioned in the base assembly 322) is depicted as overlapping, in practice it can be configured and positioned so as to provide more of line-to-line fit that is suitable to address the needed tolerances while allowing for desirable assembly of the lamp.

When the LED in the LED module 314 is being driven, the current passing through the LED generates heat that is passed to the heat spreader 228. The heat then passes to the heat sink 226 and heat spreads outwardly to the fins 238. The apertures 292 and the channels 248/270/297 provide effective heat transfer passages to conduct heat such that heat can be dissipated over the length of the fins 238. As a result, when a plated plastic is used for the heat sink 226, the heat is effectively dissipated over the entire heat sink 226. While the lower section 264 and the secondary lower section 274 are not shown with apertures therethrough, it is to be understood that apertures (like apertures 68, 76 of the heat sink assembly 26) can be provided through one or both of these sections 264, 274.

Figure 23:
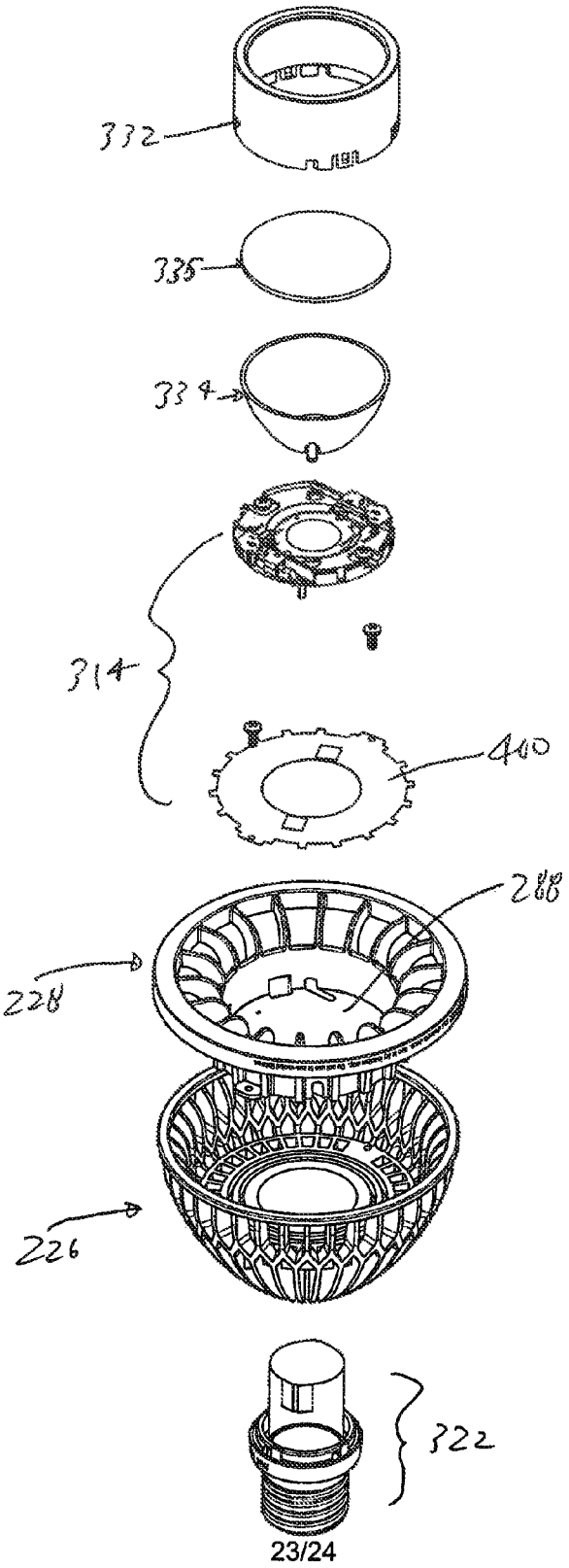
FIG. 23 is an exploded perspective view of the components of an embodiment of a lamp.

FIG. 23 shows a heat puck or a phase change pad 400 incorporated into the LED module 314. The heat puck/phase change pad 400 is provided on the underside of the base of the LED module 314 and may be a conductive element that is integrated into the LED module 314 and attached thereto by a thermally conductive epoxy. In an alternative embodiment, the heat puck/phase change pad 400 can be a dispensed conductive material, such as (without limitation) a thermally conductive epoxy or solder. The LED module 314 seats on the upper surface of the plate 288 of the heat spreader 228 such that the heat puck/phase change pad 400 contacts the plate 288 and the LED is thermally coupled to the heat spreader 228.

The heat puck 400 and the heat spreader 228 can be configured so as to have sufficient high thermal conductivity so as to be substantially irrelevant to the thermal resistivity of the lamp 220. For example, the heat puck 400 can be soldered to the heat spreader 228 and as the solder tends to have a thermal conductivity of greater than 15 W/mK and is layered relatively thin, it tends to not be a significant factor is transferring heat away from the LED. Furthermore, as the heat puck 400 and the heat spreader 228 tend to be made of materials with high thermal conductivity (typically greater than 50 W/mK), there tends to be very little thermal resistance between the heat puck 400 and the heat spreader 228.

In each embodiment, the heat sink 26, 226 can be formed of a plated plastic. The plating on the heat sink 26, 226 may be a conventional plating commonly used with plated plastics and the heat sink 26, 226 may be formed via a two shot-mold process. It is also envisioned that the heat sink 26, 226 could be formed as an aluminum piece. The benefit of aluminum is that heat conducts readily throughout the heat sink 26, 226, thus making it relatively simple to conduct heat away from a heat source. While aluminum acts as a good heat sink due to its acceptable heat transfer properties, aluminum is more difficult to form into complex shapes and therefore the designs that are possible with aluminum are somewhat limited. Furthermore, aluminum acts as a conductor and thus may require additional electrical isolation. Plated plastics can be used to conduct heat with the plating being used to transfer heat along the surface away from the heat source. The conducting of heat away from a heat source is more complex when a plated plastic is used as the plating tends to be the primary path for heat transfer if a desirable performance level is to be achieved. It has been determined that to efficiently use plated plastic, therefore, a simple heat sink design such as would be ample for an aluminum heat sink may not be appropriate to provide the desired performance. The illustrated designs provides a number of vertical channels 48, 248 between the internal surface of the heat sink that mates with the heat spreader and the external surface and the vertical channels, in combination with one or more grooves (as depicted, the circular grooves 253*a*, 253*b*) the heat sink provides a number of thermal channels that can be shaped as desired and allow thermal energy to ready pass to the external surface of the heat sink in a composite plated plastic configuration. Furthermore, using a plated plastic design, for the heat sink 26, 226 can provide both the support for the LED assembly 22, 22*a* and thermal dissipation. Other options for heat sinks and spreaders include the use of glassy metallic materials that can be formed in a mold, however such materials tend to be heavy and thus the ease of manufacture will need to be balanced with weight considerations.

As can be appreciated therefore, depending on the thermal load and other design considerations, other materials may also be used for the heat sink 26, 226. For example, insulative materials with thermal conductivity greater than 5 Kelvin per meter-watt could be used for certain applications and high performance insulative materials with thermal conductivity greater than 20 Kelvin per meter-watt would be beneficial for a wider range of applications. To date, however, insulative materials with such thermal conductivity are relatively expensive and therefore may not prove commercially desirable, even if they would be functionally desirable. As a result of the construction of the lamp 20, 220, however, the height of the lamp 20, 220 can be less than 90 mm while allowing for an output of greater than 500 lumens and providing less than a two degree C/watt temperature rise (which in an embodiment may be less than 1.5 C/W) between the led array and the external surface of the heat sink. As the temperature of the heat sink is not expected be perfectly uniform, the temperature rise can be determined on an average basis. In an embodiment, the height of the lamp can be less than 90 mm while the output can be greater than 650 lumens while requiring less than 15 watts of power and having a thermal resistance between the LED array and the external surface of the heat sink that is less than 2 C/W and preferably less than 1.5 C/W.

Figure 24:
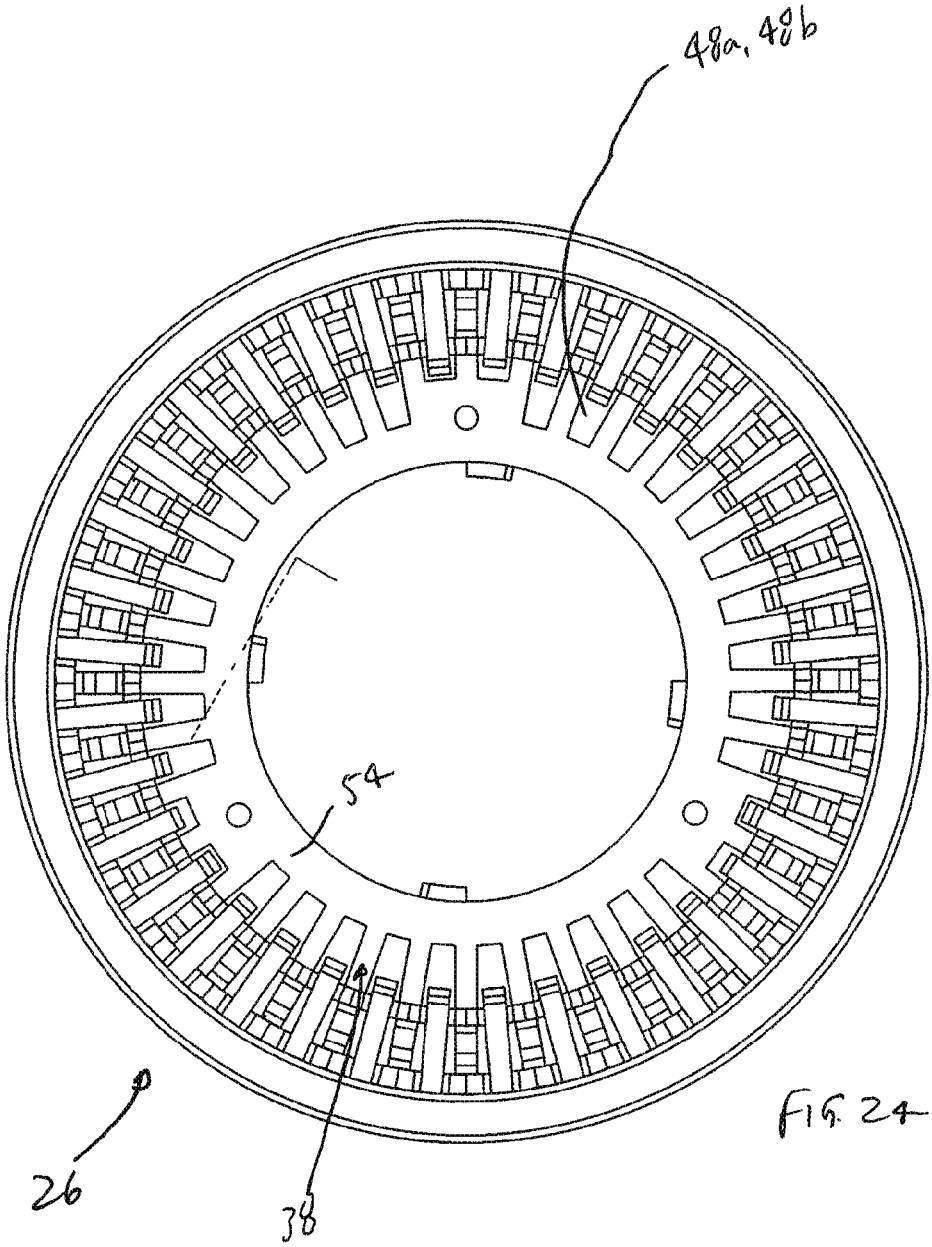
FIG. 24 is a top plan view of an alternate heat sink that can be used in a lamp.

As shown in FIG. 24, the heat sink 26 can be modified to eliminate the arcuate pieces 60 such that channels 48*a*, 48*b* are combined (the arcuate pieces 60 of heat sink 226 can likewise be eliminated to combine channels 148*a*, 148*b*). In this modified heat sink 26, the first, second and third rows of apertures 92, 96, 98 of the heat spreader 28 would seat over the respective combined channel 48*a*/48*b*.

As can be appreciated, therefore, the first surface 288*a* of the heat spreader 228 supports an LED array. Thus the LED array is configured to direct light in a first direction A. The heat spreader 228 further has fins 291 that extend from the first surface in the first direction (thus allowing thermal energy to be directed in the first direction. The heat sink 226 has thermal channels that allow thermal energy to be directed along the surface of the heat sink in a second direction B. Thus, the depicted design provides for bi-directional thermal transfer. As can be appreciated, if the lamp is mounted in a socket (as is customary for can-type lighting), the fins 291 help provide surface area closer to an opening of the can so as to improve thermal transfer away from the lamp.

It should be noted that for certain applications, it may be desirable to provide a heat spreader or heat sink that includes a vapor chamber so that heat can be even more effectively conducted away from the LED. Such applications include high powered LED arrays. For other applications, however, a material with a high thermal conductivity may be sufficient. Vapor chambers for use with heat sinks/heat spreaders are known in the art, as shown for example in U.S. Pat. Nos. 5,550,531 and 6,639,799, which disclosures are herein incorporated by reference in their entirety.

It should be noted that in general, thermal resistance along a path can be considered as the thermal resistance of each component and interface being in series with the other components and interfaces in the same path. Therefore, to provide a desired total thermal resistance, each component can be optimized separately. It should be noted that due to the series nature, selecting one component that is inefficient can prevent the entire systems from working as intended. Therefore, it can be beneficial to ensure each component is optimized for the intended performance level. Furthermore, if desired, certain components can be made integral so as to avoid an interface (as each interface tends to increase the thermal resistance). For example, the heat spreader and the base of the LED module could be integrated (e.g., the LED array could be mounted on a larger base that was equivalent to the heat spreader).

While certain preferred embodiments are depicted and described, it is envisioned that those skilled in the art may devise various modifications of the depicted embodiments without departing from the spirit and scope of the appended claims.

The invention claimed is:

1. A lamp comprising:

a conductive heat spreader having a first surface and a plurality of fins positioned in a first direction from the first surface;

a light emitting diode (LED) array thermally coupled to the first surface; and a heat sink including a base with a surface and a plurality of fins extending outwardly from the base, a upper portion of the plurality of fins extending in the first direction from the base and a lower portion of the plurality of fins extending in a second direction from the base, wherein thermal channels couple the surface of the base with the lower portion of fins, wherein the heat spreader includes a plurality of apertures therethrough and a plurality of notches therein, each of the notches extending from an edge of the heat spreader to form a plurality of fingers, the apertures and the notches aligning with the thermal channels.

2. The lamp of claim 1, wherein the plurality of fins of the heat spreader are positioned so as to extend further in the first direction than the plurality of fins of the heat sink.

3. The lamp of claim 2, wherein the heat sink is formed of a plated plastic.

4. The lamp of claim 1, further including power conversion circuitry in the base of the heat sink that is potted, the circuitry configured to provide DC power to the LED array.

5. The lamp of claim 4, further including an Edison base attached to the heat sink, the Edison base electrically isolated from the heat sink and electrically coupled to the power conversion circuitry.

6. A lamp comprising:

a conductive heat spreader having a first surface and a plurality of fins positioned in a first direction from the first surface;

a light emitting diode (LED) array thermally coupled to the first surface; and a heat sink including a base with a surface and a plurality of fins extending outwardly from the base, a upper portion of the plurality of fins extending in the first direction from the base and a lower portion of the plurality of fins extending in a second direction from the base, wherein thermal channels couple the surface of the base with the lower portion of fins, wherein the upper portion of each the fin of the heat sink includes a first section and a second section connected together, the first and second sections being angled relative to each other and relative to the lower portion.

7. The lamp of claim 6, wherein the first and second sections and the lower portion generally form a Y-shape junction.

8. The lamp of claim 7, further including an aperture provided through each Y-shaped junction.

9. The lamp of claim 8, further including a reflector configured direct light emitted from the LED array in the first direction.

* * * * *